US007789393B2

(12) United States Patent
Tucker et al.

(10) Patent No.: US 7,789,393 B2
(45) Date of Patent: Sep. 7, 2010

(54) RESOURCE SENSITIVE GAME SYSTEM AND METHOD

(75) Inventors: Amy E. Tucker, Seattle, WA (US); Tyler Bielman, Seattle, WA (US)

(73) Assignee: Matter Group LLC, Seattle, WA (US)

( * ) Notice: Subject to any disclaimer, the term of this patent is extended or adjusted under 35 U.S.C. 154(b) by 83 days.

(21) Appl. No.: 11/674,010

(22) Filed: Feb. 12, 2007

(65) Prior Publication Data

US 2008/0036150 A1 Feb. 14, 2008

Related U.S. Application Data

(60) Provisional application No. 60/772,436, filed on Feb. 10, 2006.

(51) Int. Cl.
*A63F 1/00* (2006.01)

(52) U.S. Cl. ..... 273/272; 273/276; 273/293; 273/299

(58) Field of Classification Search ..... 273/272, 273/275, 276, 293, 299
See application file for complete search history.

(56) References Cited

U.S. PATENT DOCUMENTS 4,420,157 A * 12/1983 White et al. ..... 273/272
5,524,898 A 6/1996 Pavlovic
5,662,332 A 9/1997 Garfield
6,318,723 B1 11/2001 Kurita
6,435,508 B1 * 8/2002 Tavel ..... 273/292
6,585,265 B2 7/2003 Dewa et al.
6,938,899 B2 9/2005 Kenney et al.
7,293,773 B2 * 11/2007 Bradley ..... 273/299
2003/0062679 A1 4/2003 Chang
2005/0280213 A1 12/2005 Kenney et al.
2006/0017229 A1 1/2006 Hayakawa et al.
2006/0202423 A1 9/2006 Tanaka
2006/0220317 A1 10/2006 Edwards

* cited by examiner

*Primary Examiner*—Benjamin H Layno
(74) *Attorney, Agent, or Firm*—Jellett Law PS

(57) ABSTRACT

A resource component for a game system. The resource component has a game play structure. It also has a linking mechanism. The linking mechanism is arranged about the game play structure. During play of the game, the linking mechanism dictates a gameplay condition. This gameplay condition is the availability of the game play structure to be included into the game system by linking to opposing resource components already present in the game play system. The game system is build around a central component.

28 Claims, 17 Drawing Sheets

RESOURCE SENSITIVE GAME SYSTEM AND METHOD

RELATED APPLICATIONS

This application claims priority benefit of U.S. Ser. No. 60/772,436, filed Feb. 10, 2006 and according to 35 U.S.C. §119 (e) (3), with a priority date falling on a Saturday, thus extending the period of pendency of said provisional application to the next succeeding secular or business day being Feb. 12, 2007.

BACKGROUND

Background Art

US 2006/0202423 discloses a battle card game, where the players can concentrate on progress of a game. A combination card set comprising four cards is included in a plurality of cards forming a deck. In the Summary of the Invention section on page one, "another object of the present invention is to provide a battle card game which enables a player to easily complete a conceptual image (image or concept) on a play field by arranging a plurality of cards on the play field."

US 2006/0220317 discloses a trading card game using historical figures from world history. A number of standard size playing cards are provided based on a figure, event or object found in true world history. Each card contains a summary of facts from the history of the historical subject. In paragraph 6 on page 1 in the Brief Summary section, "the two main objectives are to gather the most moral points or to capture all of the plurality of the player's country cards." Further in the same paragraph, "country cards are placed in front of the player's deck, so that the player's deck is set between the player and the country cards, both being to the right and upside down. At the beginning of the game, the player picks one country from the top and places them level in front of the player just an inch to the left of the player's deck. The player draws five cards and at the player's turn, the player can play people cards in front of the country card so desired, to have the cards defend; as the game continues the player will gather more country cards with the help of explorer cards, to place level and to the left of the first country card."

US 2006/0017229 discloses a card game and methods of play, where the invention is a card game comprised of at least one warrior card, one technique card, one power card, and one field card. The invention involves the use of a battle binder. On page one in the Brief Summary of the Invention section, "the game simulates battles between warriors having different abilities and powers. All of the cards have . . . a face side comprising the following: warrior cards, technique cards, power cards, and field cards." On page two in the detailed description of the invention section in paragraphs 42-48, "each player participating in the game has his own play mat and deck of cards. Each play mat is organized in the following manner: a field area is formed by placing the two play mats together. This is where the battle takes place. A deck area where a player's shuffled deck is placed face down. A discard pile where the discards are placed face up in this area. A realm of warriors area: where cards are placed in this area during the deploy warriors phase, warrior cards may be moved to or from this area during the move phase. An energy area: any type of card may be placed face down in this area during the energy phase to be used to pay future energy costs."

US 2005/0280213 discloses a collectible card game and method for playing the same, where the games are for two or more players where each player attempts to be the first to traverse a path consisting of a series of tasks. The game components such as collectible trading cards may be used to represent tasks, movers, and effects; the game may include a racing theme. Players form a path by arranging player selected task cards on a playing surface; each task card including indicia representing a task, such as numerical value. Players then move mover cards along the path, with each mover card including indicia representing attributes of the mover to indicate whether the mover is able to accomplish a selected task, such as corresponding numerical value. Players may play effect cards to modify the attributes of the movers, such as to accomplish a task or hinder an opponent's progress, and to modify game rules and other aspects of the game environment.

US 2003/0062679 discloses a strategy game or a map where the strategic worth is used in a paper card game. General cards and soldier cards have powers and abilities. A rule for executing layout operations as the game starts is determined. Players may execute in normal mode, and war mode, as well as programs such as a system of conscription, entering and leaving a city, executing a function card for modifying the effect of an attack and defense, getting war trophies as for example after a city is occupied.

U.S. Pat. No. 6,938,899 discloses a tile-based board game. The game has game pieces and rules for playing a game where the goal of the game is for a number of players to play one another and defeat an opponent through a battle of game pieces. The tile-like pieces are used to block or challenge an opponent through the use of indicia on the outer periphery of each piece. Several levels of play are provided through the use of several game piece sets, which are obtainable independently. In the Summary of the Invention section in column 1 around line 30, "the present invention provides rules for playing a board game. The board game uses tile-like game pieces that are arranged in a side-by-side relationship. Numerical printed indicia or other indicators on the face of the tile, and preferably along the outer periphery of the face of the tile, may be used for comparison against similar indicia on adjacent tiles. Preferably, one or more dice are used to determine which of the indicators is to be compared to an adjacent indicator. The indicia used in the game are based on characters, items, and monsters appearing in the YU-GI-OH television program."

U.S. Pat. No. 6,585,265 discloses a board game played by plural players and method of play thereof, where plural dice selected from among plural dice can be unfolded two dimensionally or rolled. According to the results of the rolling of the dice, the dice is unfolded and placed on the play field. On the unfolded dice, a player places his or her piece. In the Summary of the Invention section in column 2 around line 25, "the present invention comprises a play field having a plurality of polygonal grids. The shape of the polygonal grids may be triangle, square or pentagon." Further down in line 43, "the game component set includes a plurality of dice, plurality pieces having visually identifiable features and belonging to predetermined plural groups and/or predetermined plural levels and a plurality of cards corresponding to each piece which respectively shows identification of the piece, capacity (special power, effect, etc.), conditions in which power within capacity can be wielded or exerted, and a group and/or level the piece belongs to." Further down at line 54, "the die of the polyhedron can be unfolded in the present invention."

U.S. Pat. No. 6,318,723 discloses a game card, where the card enables a plurality of players to enjoy a psychological sympathetic game. The card has "information entering spaces" and the players enter information into the spaces as those cards are received from the dealer. Game cards are collected after the information is entered, and the game cards are arranged in accordance with the information in the "information entering spaces" of the cards. The cards have a connecting part for connecting one game card to another. The connecting part is configured as a protrusion having a shape broadened toward a free end which can enter or correspond to a recess on a corresponding card. By using the connecting parts, the cards can be lined up easily and each player's score can be calculated rapidly and reliably.

U.S. Pat. No. 5,662,332 discloses a trading card game and method of play where the game play uses game components that are in the form of trading cards. The game components may take other forms such as board games, electronic games, video games, computer games and interactive network environments. In one version, the game components comprise energy or mana cards, and command or spell cards. Players construct their own library of cards, and play their library or deck of cards against an opposing player. In the Summary of the Invention section in column 5 around line 4, "another aspect of the invention includes the steps of executing a turn include the sub steps of tapping the energy elements when used by command elements, the sub step of tapping comprises flagging the energy elements so all players can see the energy elements being used. In addition, the step of executing a turn further includes the step of untapping an energy element by unflagging energy elements so that all players can see the energy element is available for use."

DESCRIPTION OF THE PREFERRED EMBODIMENTS

Generally speaking, one embodiment is a method and apparatus which enables individuals playing a card game to model real-world interactions using a card interaction mechanism. This card interaction mechanism can be utilized to model various environmental ecosystems having multiple species interacting with one another within these ecosystems. Other interactions include for example, baseball teams, basketball teams, tennis, and other sporting events which model human work environments. Also environments which have multiple forces with multiple entities acting within these environments which model ramifications of decision-making processes within these environments based on the various card element characteristics.

In one embodiment, this card interaction mechanism enables the environments to be developed through a one-on-one player (or in other embodiments, a multitude of players) competition in, for example, ecologically sensitive ecosystems.

Figure 1:
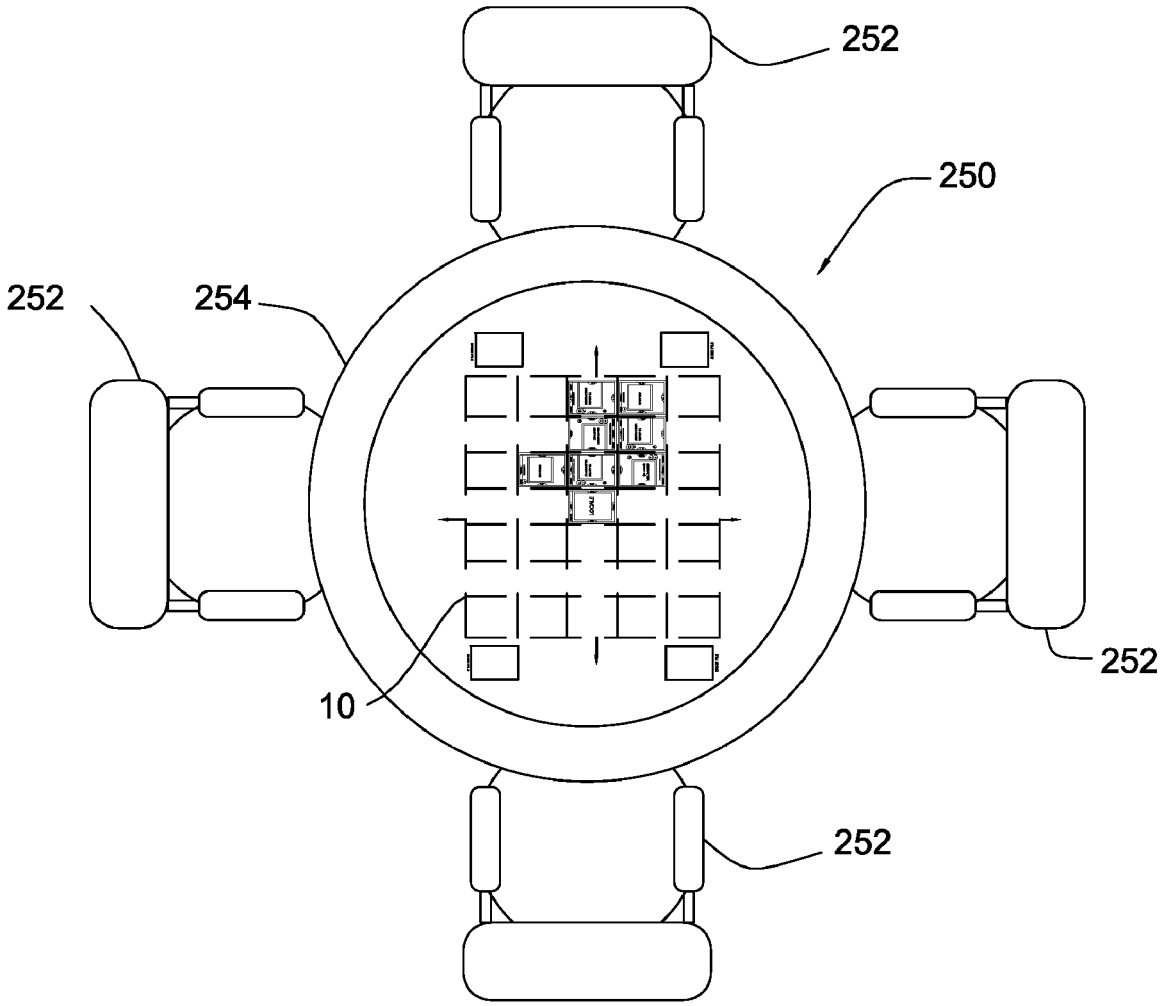
FIG. 1 is a plan view of a game at a game table.
Figure 2:
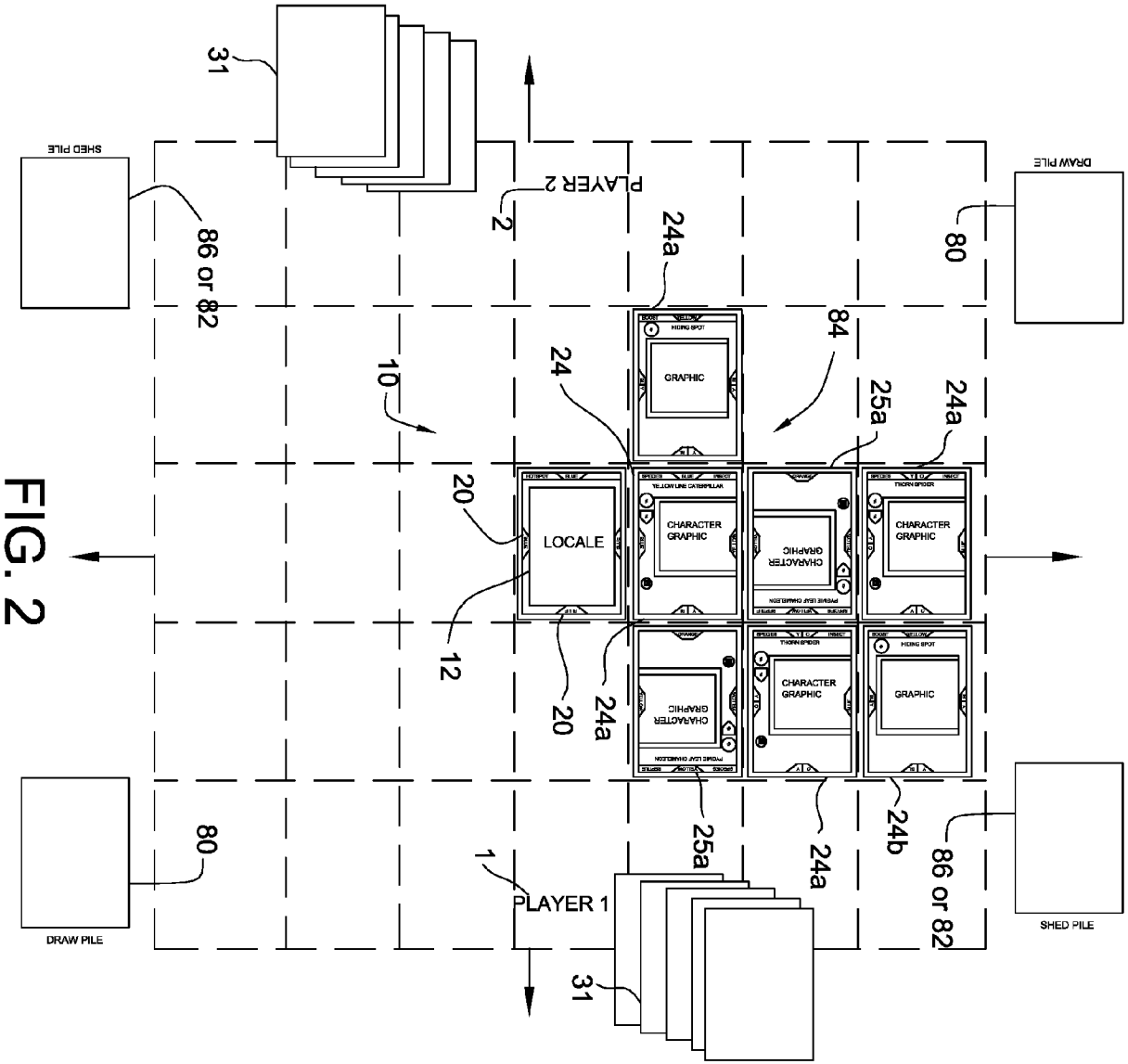
FIG. 2 is a plan view of the game.

Referring to FIGS. 1 and 2, a first embodiment of the card interaction game system will now be provided.

The players may congregate about a table 254 and start a physical card game system 250. The players may utilize player chairs 252 and optionally use a play mat 10, or use the surface of the table as the playing field 10 or play area 10 as seen in FIG. 2.

Two players are placed on either side of a game mat or game field 10. Player 1 and player 2 each have a number of card components at their disposal.

Figure 8:
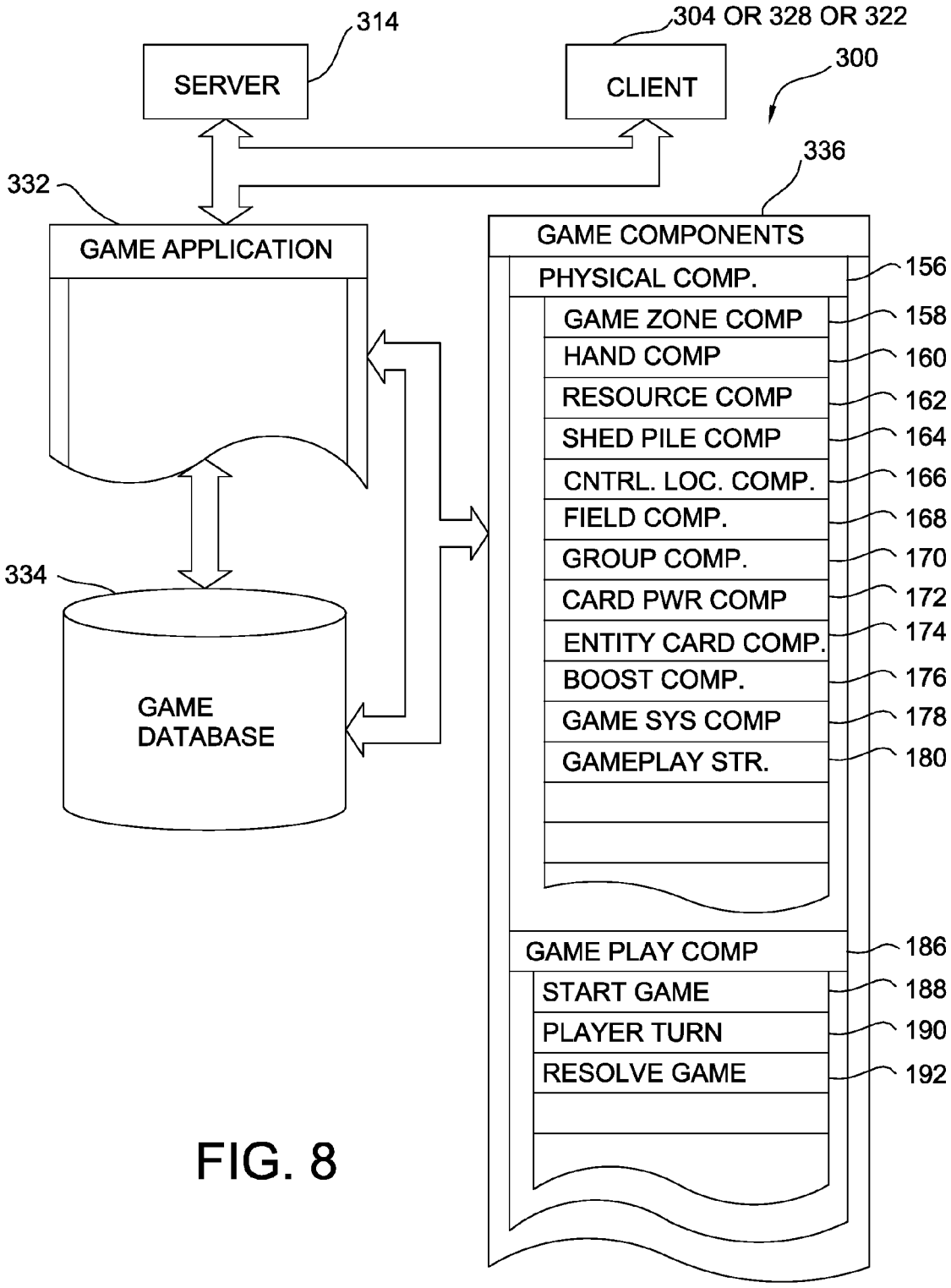
FIG. 8 is a schematic view of a game application.

The game system is developed around a central component 12 or hotspot card 12 in this particular embodiment. The hotspot card 12 represents a resource sensitive geographic location which supports an ecosystem and various habitats. The hotspot card or central component 12 is placed within the field 10. As mentioned previously, the field can be a playing surface on a table, a mat, a three dimensional volume, or a three dimensional field constructed through the use of a graphic engine enabled within a software environment or application 332 (FIG. 8). Nonetheless, when using a flat surface, the players adhere to an implied or actual grid for ordering the arrangements of the card components to be discussed below.

The central component 12 acts as the beginning point for interaction between the first component group and the second component group. This interaction develops the game system or in the present embodiment, an ecosystem.

Figure 3:
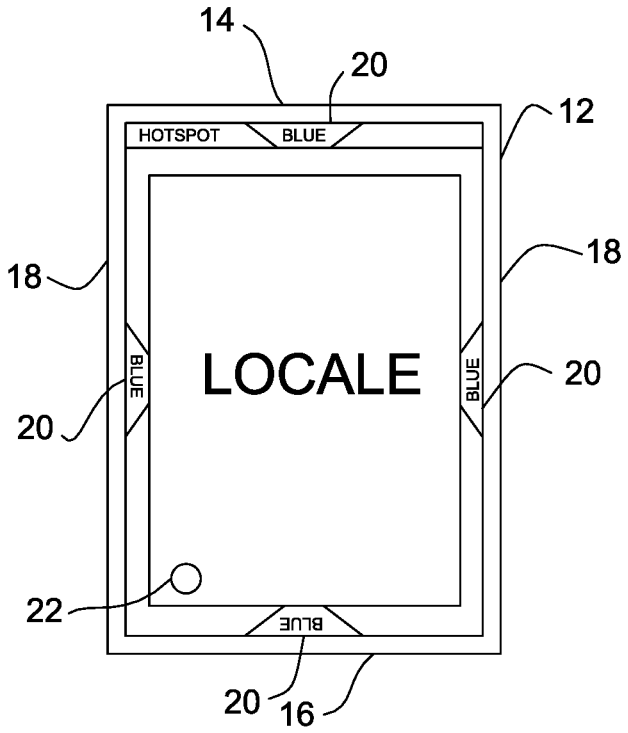
FIG. 3 is a plan view of a central locale component.

Referring to FIG. 3, the central component 12 has arranged around its edges, central link components 20 which enable the beginning card components to enter into the playing field 10. In this particular embodiment, all of the card components have an orientation which is to be read from the top of the card to the bottom of the card.

The gameplay structure can be two-dimensional or three-dimensional depending on the medium within which the game is being played. In the two-dimensional arrangement, the gameplay structure can be a simple playing card. Playing cards can take many different arrangements and shapes. One shape is a typical rectilinear trading card. Other shapes can be pentagons, hexagons, octagons, squares, or irregular shapes such as puzzle pieces.

In the three-dimensional arrangement, shapes can take the form of the basic geometric volumes or solids, such as but not limited to, cubic, pyramids, spherical, cylindrical, buckyballs, etc. Other three-dimensional shapes can be three-dimensional reproductions of the real world inventory item being represented within the game. For example, within a 3-D multiplayer online gaming environment, such as second life, the creatures within a hotspot may be accurately reproduced in three dimensions or caricatures of the creatures may be created depending upon the physical game engine provided within the online gaming environment. The link components 30 which would in some form match or connect or be a part of the two-dimensional or three-dimensional figures or shapes will depend upon the particular medium within which they are implemented.

In this particular embodiment, each card component has a game play structure, which will be discussed more fully below, but in the current embodiment has four sided two-dimensional card component, with a top edge 14, a bottom edge 16, and two equal but opposite side edges 18. The central link components 20 enable the player's card components and resource components to be initialized and interact in the game Within each environment a certain set of entities can operate. Referring to FIGS. 3-6, these entities are the primary game piece components within the environment which dictate play or decisions within the environment 84.

In the present embodiment, these fall into three categories. The first category has to do with value and scoring within the game, the second category has to do with the card characteristics relating to the real world inventory, and the third category has to do with the card interaction mechanism.

In the first category, a point component 28 indicates the level of strength that the particular card component 24 has during the game play with other card components within the playing field 10. This point component 28 can be represented as value, energy, or any other type of indicator which conveys strength.

The second component is a victory point component 32. This victory component 32 indicates the value of the card component 24 for scoring at the end of the game. Both the point component 28 and the victory point component 32 may in some respects correlate to the strength of the real world inventory.

Now discussing the real world inventory. This real world inventory category takes existing actors within the physical world such as for example, the common species, rare species, and endangered species and utilizes these real-world characteristics by placing representation of these characteristics onto the card component 24. Other types of real world physical objects are further conceived. These may include retail objects, business objects, sporting objects, game objects, agricultural objects, political objects, or any item which is existing or present in the physical world and can be represented through its characteristics on the game components, and in the present embodiment, the card components.

With regard to the real world inventory characteristics, the card component 24 includes a common name component 26, a hotspot component 34, rarity component 38, endemic component 40, species type components 37, card type components 36 or 68, and a graphic field component 44.

The card components 24 as well as the other game component pieces to be discussed below, in some instances need to enter into the playing field 10 through a game play condition. The game play condition is dictated by, in one form, a linking mechanism where one linking component 30 on the card component 24 matches an opposing linking component 30 on an existing card component 24 within the playing field.

Also, specific rules for various card components 24 may also dictate how the cards are to be used and how they affect the game system 84 within the playing field. These individual rules are maintained within a rules or flavor component 41 or 42.

Figure 5:
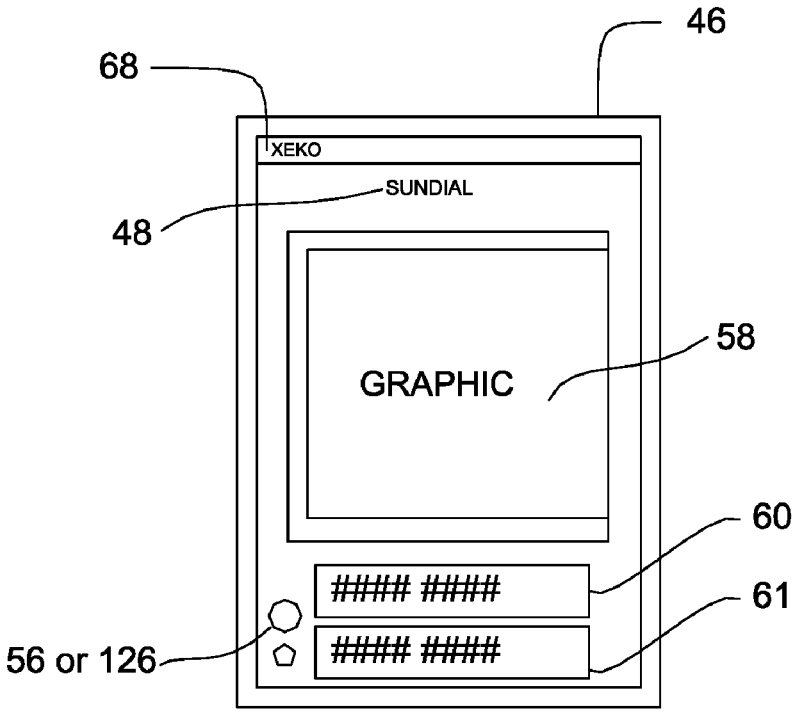
FIG. 5 is a plan view of a event card component.

Within each environment, various events and/or occurrences can occur and affect the outcome or dictate changes in play within the game as it progresses. For example, forces of nature, outside individual related events, or special entity powers affect the environments. Player 1 or player 2, if they have a card in their deck, can usually utilize these event components 46 (also known as Xeko card components 46), as seen in FIG. 5. Generally speaking, these event components 46 provide for changes within the game play. They include an event card name 48, event card type 68, symbol card components 56 or 126, and graphic illustration components 58. Also each event component 46 has a rule component 60 or flavor component 61 which further affects their use within game play situations.

In addition to outside forces acting on the environment 84 during the operation or play of the game, card component 24 to card component 24 interaction can affect the game system environment 84. A discussion of one resource component which supports such an interaction will now be provided.

Figure 6:
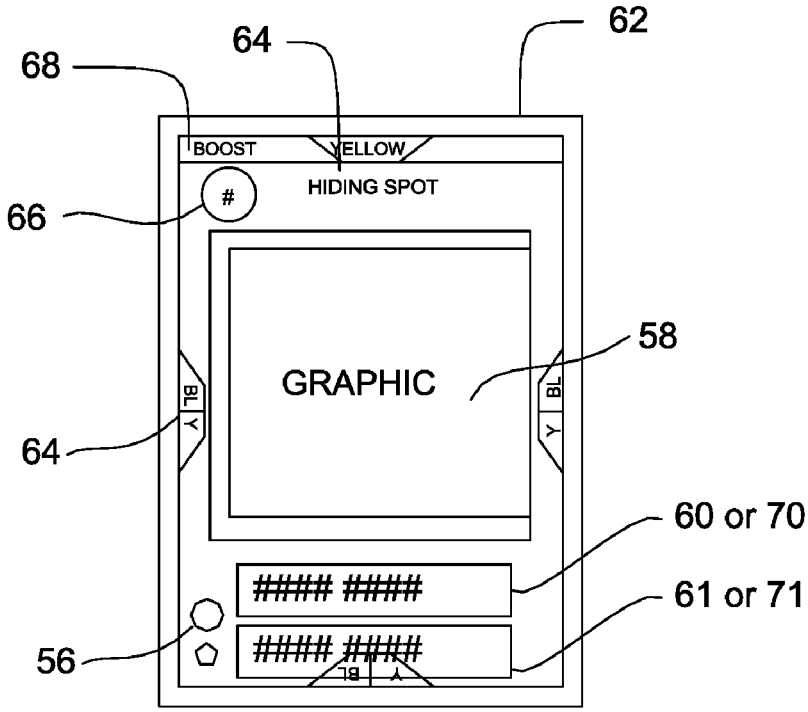
FIG. 6 is a plan view of an power card component.

Referring to FIG. 6, depending on the cards held within either the first player's hand or second player's hand, various power components 62 (also known as boost cards 62) can be used to affect the outcome of a card component to card component interaction 140 (FIG. 14), further discussed below. The boost card has components which enable it to be used within the entity to entity interaction 140. These include boost link components 64, boost points 66, boost card type 68 and boost card or rules 70 which dictate the player's use of the boost card during the interaction 140.

It is believed that it will be helpful to discuss the use of the game system components and the game system 84 in a more specific current embodiment. Discussion will take the form of describing the present game system as representing a real world inventory (in this case ecological hot spots), describing the game setup, describing the card game interaction mechanism, the basics of the particular embodiment operation, various card interaction types, the game system zones, the game play, player to player sequences or turns, and various card component elements.

Figure 4:
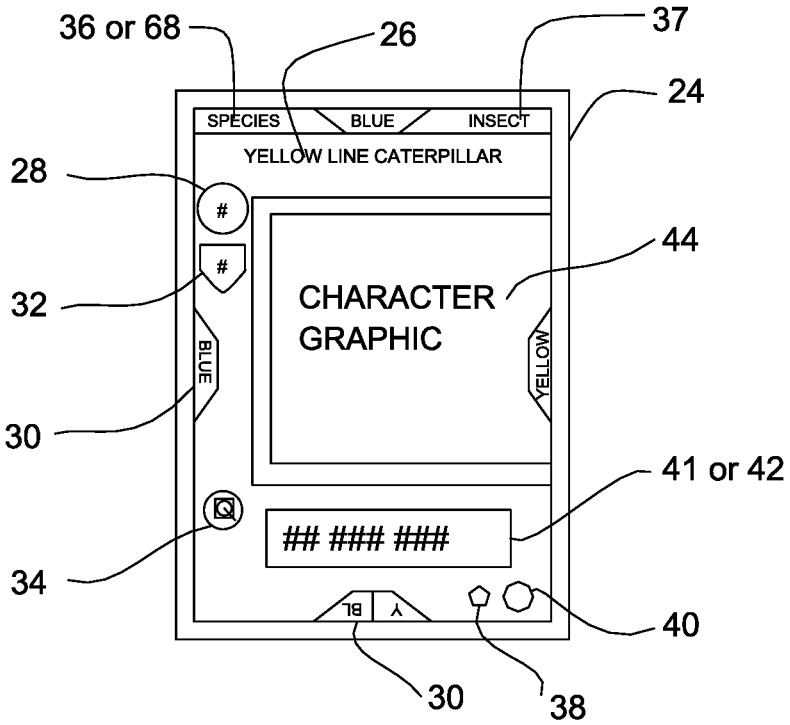
FIG. 4 is a plan view of a card component.

In the current embodiment the environment is a biodiversity ecological hotspot; one such type of hotspot first identified by Norman Myers, is considered Madagascar. These hotspots have ecologically rich and critically endangered habitats. The current embodiment is focused on these hotspots. The object of the current embodiment game play is to gather the most Eco-points 32 by supporting species cards 24 (as seen in FIG. 4), while conserving cards within the draw pile 80 (as seen in FIG. 2). A player will understand that a balance is required to support any ecosystem, the balance of spending resources to support diverse and sometimes endangered species cards 24 with conserving resources for planning for the future.

In one embodiment of the game (FIG. 2) the players may ahead of game time prepare their card decks located within the draw pile 80. Each player 1 or 2 (as seen in FIG. 2) may use a deck of 40 cards or fewer. In alternative embodiments greater than 40 cards in a deck may be used. Player 1 and player 2 should each have the same number of cards in their respective decks. In this embodiment, the deck may contain no more than three copies of the same card.

Figure 11:
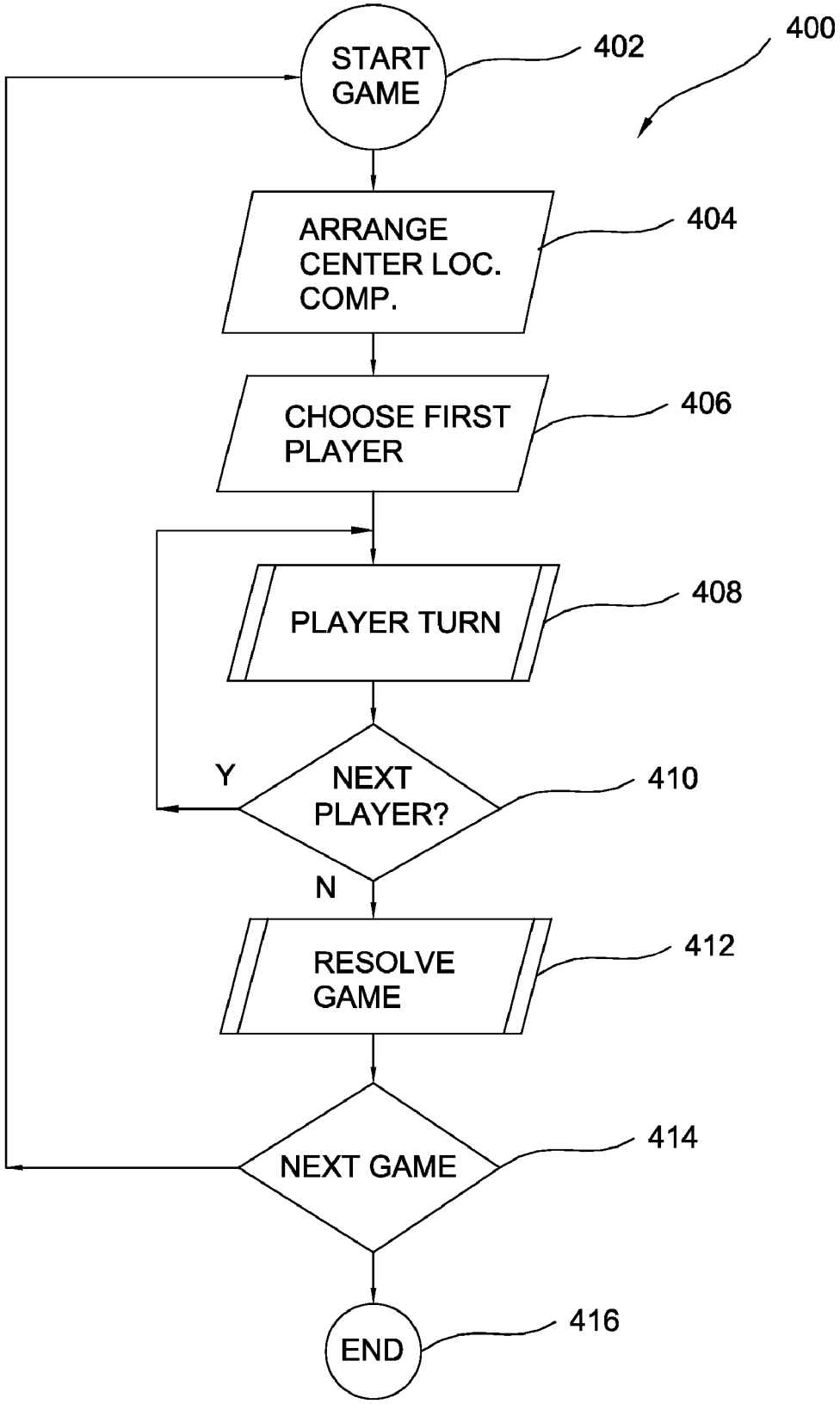
FIG. 11 is a flow diagram of a game play sequence.

Referring to FIGS. 2 and 11, the present game is started by placing the hotspot card 12 as seen in step 404 in the middle of the playing field 10. A first player is chosen at step 406. Each player, (player one and player two), shuffles their own deck 82 and offers the opposing player the opportunity to cut the deck, placing the bottom portion on the top portion. Before the players can take a turn, in the current embodiment, five cards are drawn from the deck 82 for each player to begin with an opening hand.

The first player takes a turn at step 408 followed by the next player at step 410 taking a player turn. At the end of the game, when one of the players cannot continue, the game is resolved at step 412.

Figure 14:
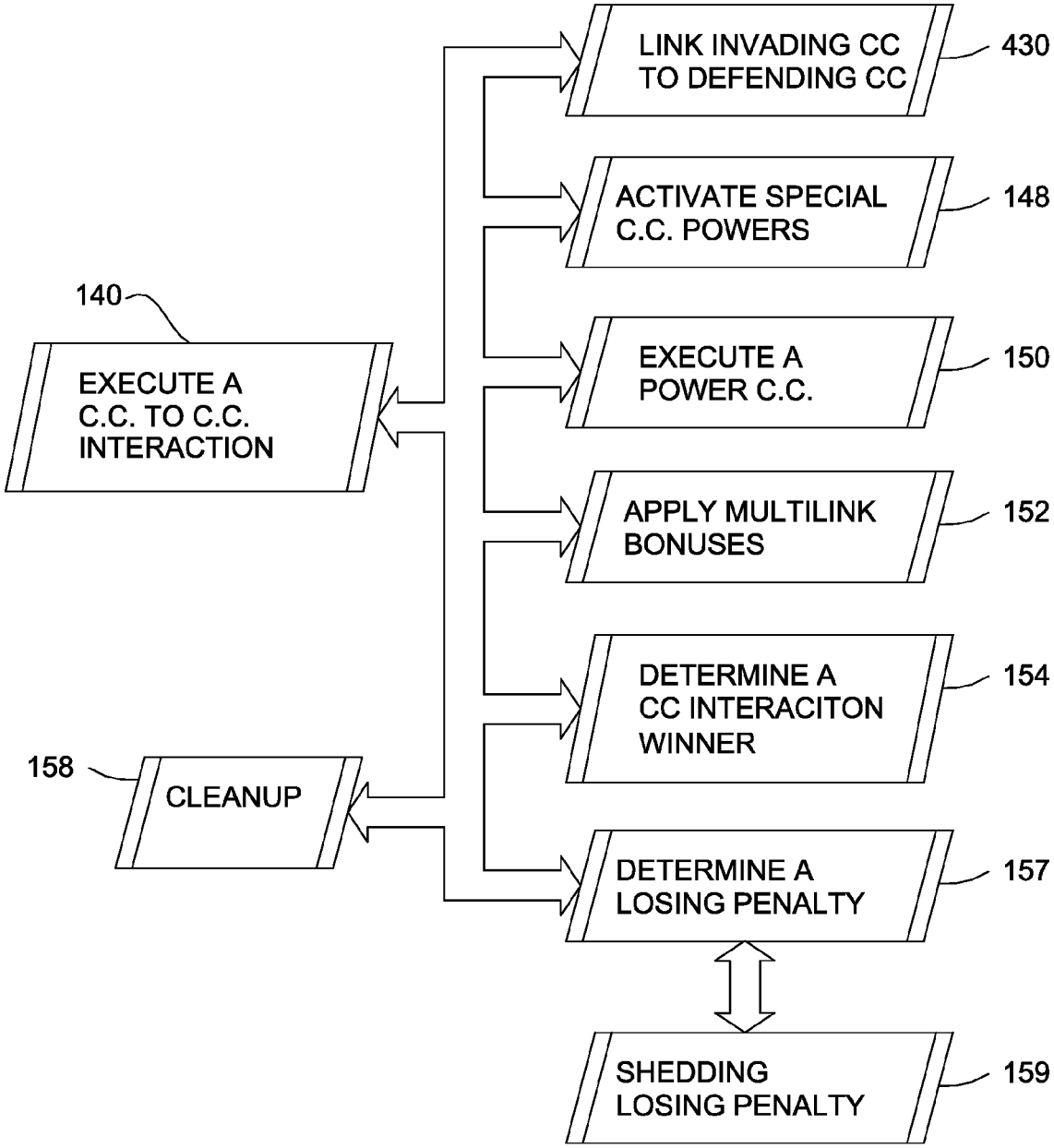
FIG. 14 is a sub-flow diagram of a player turn.
Figure 15:
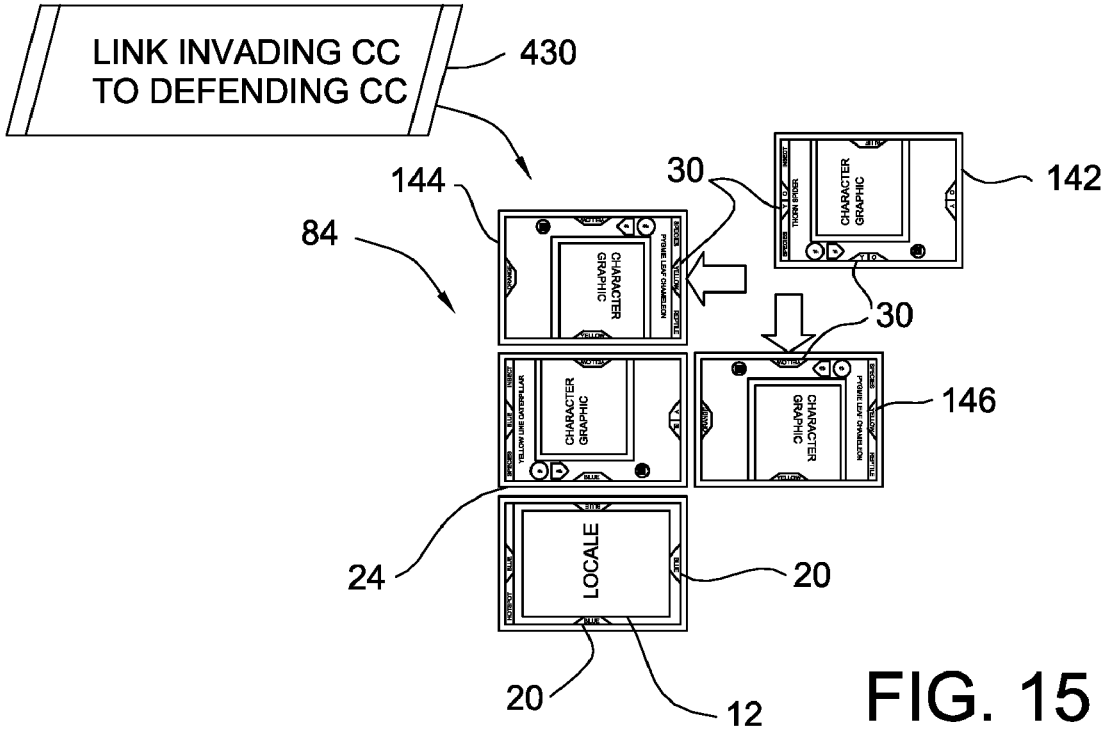
FIG. 15 is a schematic diagram of a linking arrangement.
Figure 15A:
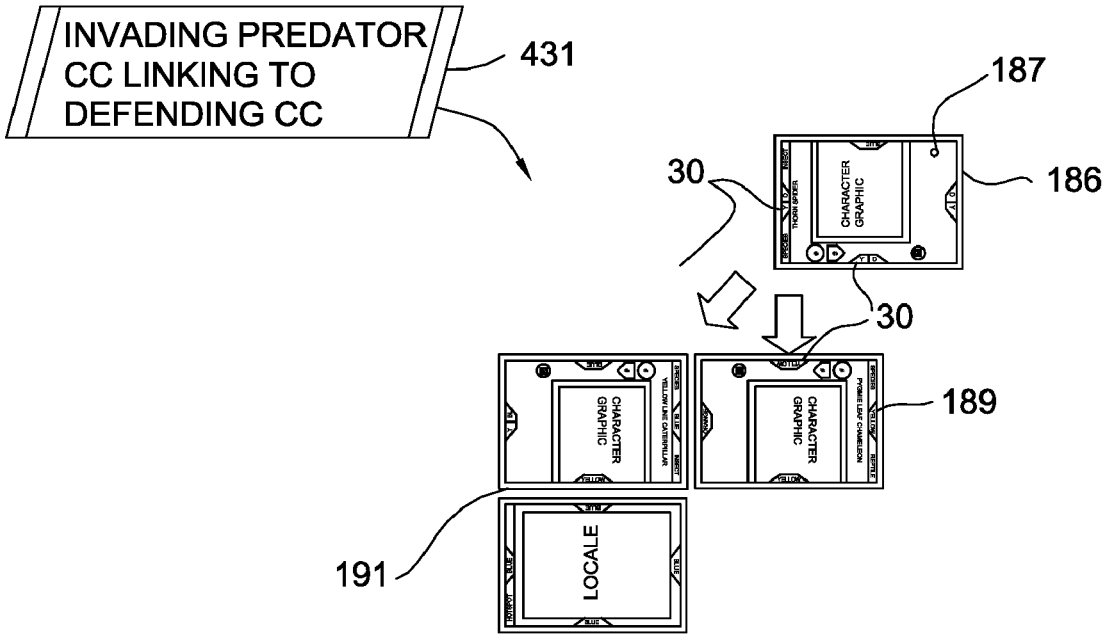
FIG. 15A is a schematic diagram of an alternative linking arrangement.

A brief discussion of the overall environmental building sequence will now be provided. Players 1 and 2 take turns playing different cards to add species cards 24, use power components or boost cards 62 during a turf war 140 (as seen in FIGS. 14, 15, 15A), or utilize event components 46 or Xeko cards 46 (as seen in FIG. 4) as well as other entity cards to be provided.

The interaction and activities of the individual species cards 24 combine to create a game system 84 (as seen in FIGS. 2 and 11), which is considered the unique environment creating an ecosystem in the hotspot location. Players 1 and 2 use strategy and luck to acquire the most points and vie to win the game.

After the system has been built, the game is ended when, as seen in FIG. 11, step 410, either player 1 or player 2 cannot draw their last card from their draw pile 80 because there are no more cards in the draw pile to continue the game play sequence 400, FIG. 11. Resolving the game at step 412 requires tallying points.

Figure 2A:
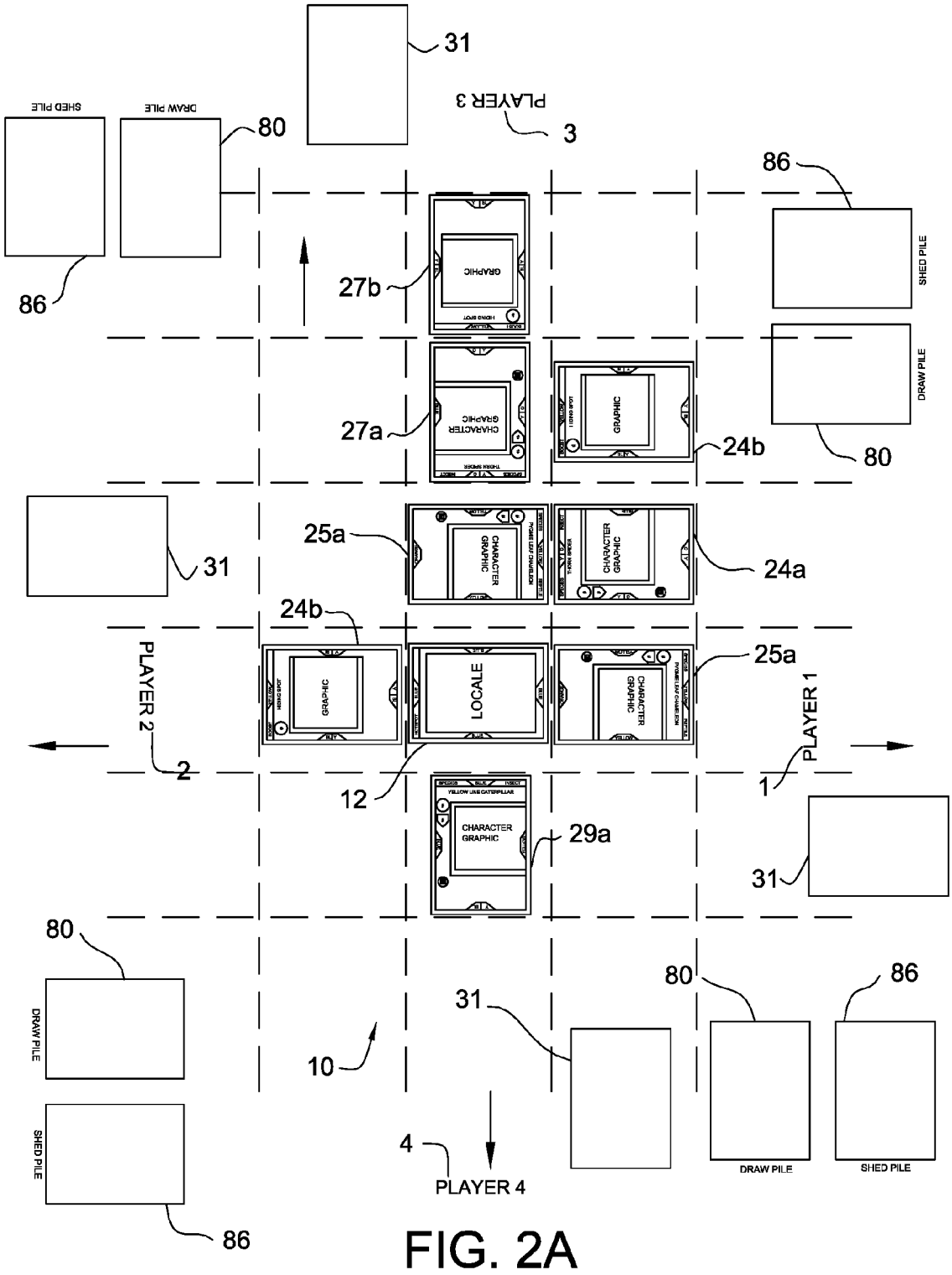
FIG. 2A is a plan view of an alternative embodiment of the game.

Referring to FIG. 2A, a multiplayer version of the game system 84 will now be discussed. For the turn sequence, the play proceeds in a clockwise direction although it can in an alternative embodiment proceed a counterclockwise direction. As in the two player version, the card components 24 face the player who owns the particular card component. In this particular arrangement, a first player 1, a second player 2, a third player 3, and a forth player 4 are competing. The first player one has a first card component group 24*a* through 24*b*. The second player 2 has a second card component group 25*a* through 25*b*. The third player has a third card component group 27*a*-27*b*. The fourth player has a fourth card component group 29*a*-29*b*. These card component groups link to and interact with one another to form the multiplayer game system 84. When a player taking turn links to more than one opponent, thus creating a turf war as discussed above, the invading species card component can choose which defending species card component to play against. MultiLink bonuses occur as normal and credit to the invading player, even if the invading player's card component links to more than one defending species cards controlled by different players. In this particular embodiment, boost cards are only played by players who are involved within the particular turf war. As players run out of resource components from their draw pile component 80, they are eliminated from the playing round. Once eliminated, the player must remove his card components or card component group from the playing field 10. When these card component groups are removed by the eliminated players, the playing field 10 opens up and can be filled by the non-eliminated players utilizing their card components. In one embodiment of the game, eliminated players cannot total their points and cannot win the game. In such an embodiment the last two players finish the game and tally their scores normally.

Referring to the card component 24, FIG. 4, a description of the relevant point components is herein provided. The game play score is kept using victory points 32. The victory points 32 are tallied at the end of the game. Turf war points or energy component points 28, are kept for resolving a species to species interaction. Both the turf war points 28 and the Eco-points 32 in this particular embodiment are located on a species card or entity card component 24.

Figure 18:
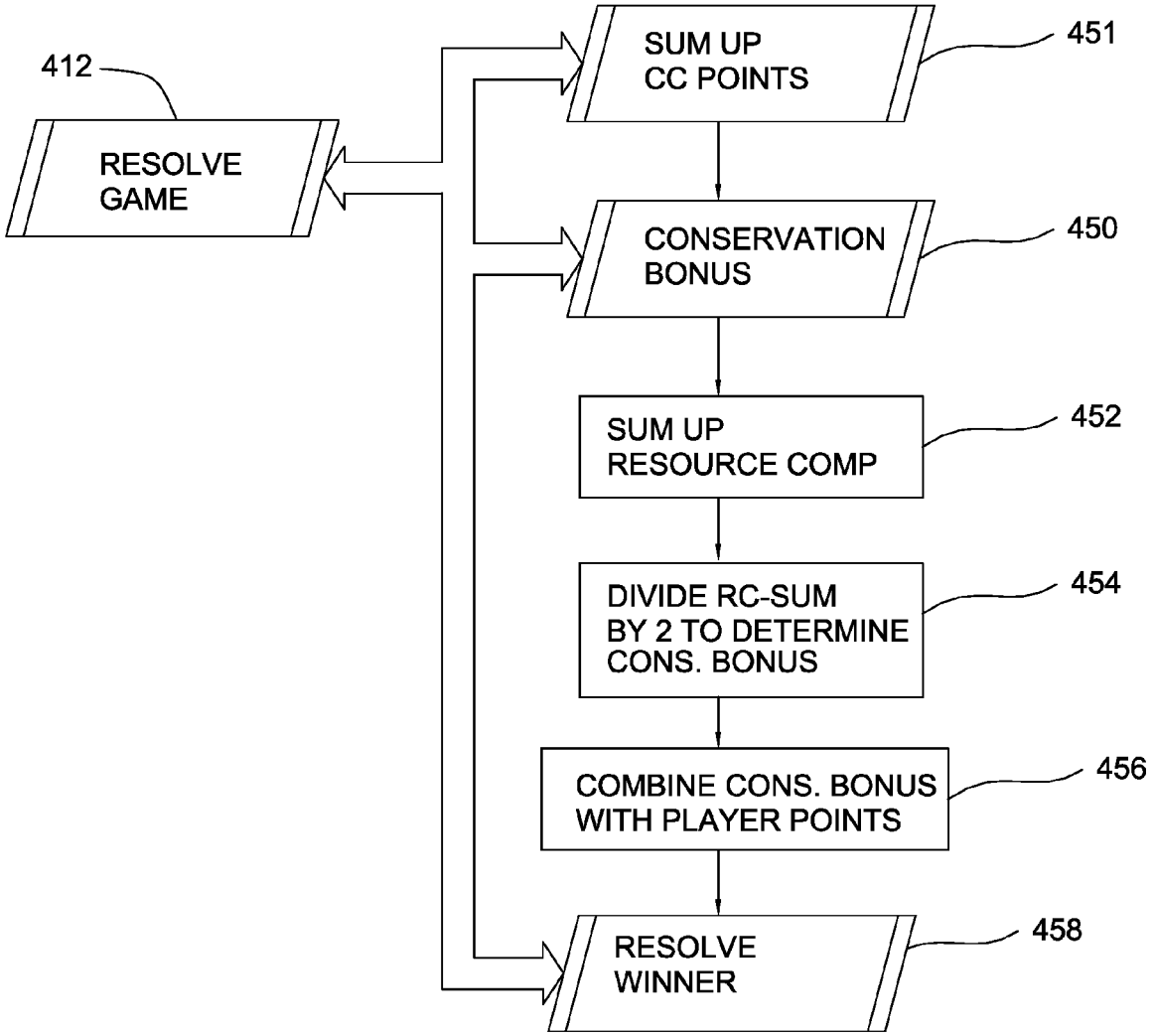
FIG. 18 is a flow diagram of resolving the game.

Referring to FIG. 18, at the resolve game stage 412, the players will need to tally the eco-points 32 by summing up the card component points at step 451. During this step, each player will discard any remaining cards held in his or her hand 31 (FIG. 2), by placing the cards into the shed pile 86 to seen in FIG. 2. Each player will then collect their respective species cards 24 from the playfield 10 and calculate their total respective points within the ecosystem environments 84 at the end of the instant game. During the tallying step 451, special points are also activated depending on the particular card component in play.

During the result game step 412, the players will also perform a conservation bonus step 450. This conservation bonus is provided for the player who still has resource components or cards remaining in his or her draw pile 80, FIG. 2. At step 452, the player or players will some up the resource components or cards remaining in their draw piles. At step 454, this sum of remaining resource components is divided by two to determine the conservation bonus points amount. At step 456, the player then combines the conservation bonus amount with his player points calculated from the summing of the points at step 451. At step 458 the player with the highest total number of points 32 is the winner of this particular game.

A further discussion of the present embodiment card characteristics will now be provided. Referring to FIGS. 1 and 8, an environmental component card 12 or hotspot card 12 is the initial card played at the beginning of the game system or ecosystem development. In general, the environmental component card 12 is the location where the game is played. The players 1 and 2, populate and link to this hotspot card 12 through the use of their species cards, Xeko cards, and boost cards as enabled by the rules. The environmental component card or location card 12 may represent any type of environment where the elements 24 or species cards components 24 populate the game system creating a unique form of the game system which is supporting the individual species cards 24 and as they interrelate to other species cards in competing for Eco-points.

In this particular embodiment, the hotspot cards 12 specific locations around the planet where ecosystems are threatened. The game is started by placing the hotspot card 12 into the playing field 10.

The entity component cards 24 or element component cards 24 or species cards 24 as seen in FIGS. 8, 3 and 1 populate the game system or the ecosystem. The elements or entity card components 24 represent actual physical specimens which are available inventory either past, present or future in the earth or physical environment. For example, the species cards 24 represent actual species which either populated the earth at one time or currently populate the earth. Also, species may be animals or plant species in this particular embodiment. A balanced ecosystem is a strong ecosystem, which relates to the gameplay and the understanding of the relationships between the species cards 24 within particular environments.

As previously mentioned, each species card 24 has a card name 26 as seen in FIG. 8, a card type 36, energy amounts 28, Eco-points or victory points 32, and species link components 30. The species link components must match other adjacent cards in order to be played within the playing environment 84. Similar components 38 are used to play the various cards. The rules text component 42 describes the individual card's powers, and the flavor text 41 is an extra set of information about the card which has no effect on the game play.

Figure 16:
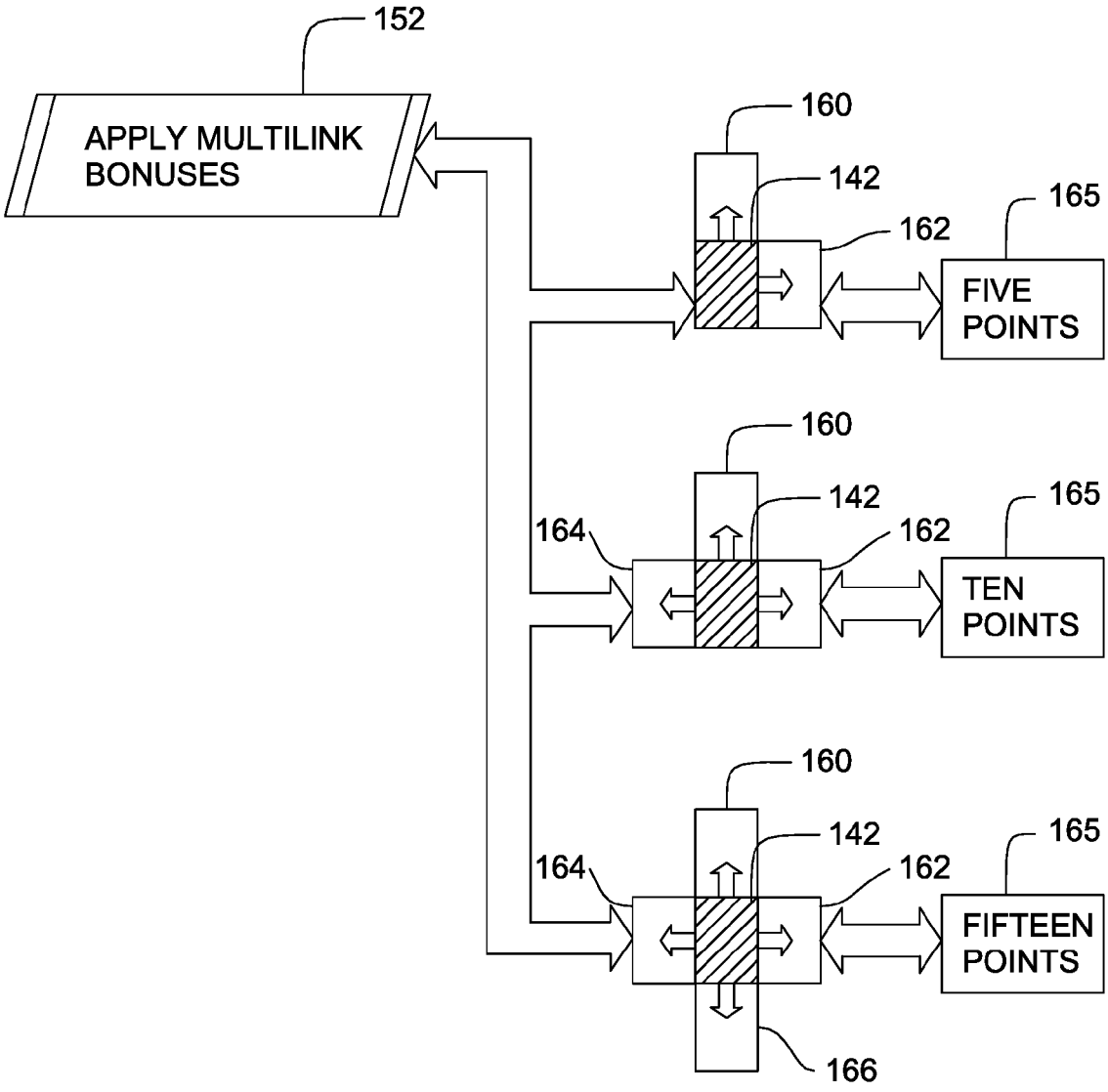
FIG. 16 is a schematic flow diagram of bonus arrangements.

Referring to FIG. 16, discussion of placing a card component in a playing field according to link mechanisms or conditions at step 422 will now be provided. These conditions are also referred to as gameplay conditions and are indicative of the gameplay structures provided by the card components as they are arranged in, say for example, two-dimensional shapes, three-dimensional shapes, etc., as indicated above. While the gameplay condition and linking mechanisms are provided on the outside edges of the card components in the two-dimensional arrangement, other two-dimensional arrangements are readily conceived as previously discussed. Thus the acceptable link mechanisms or conditions 423 and the unacceptable link conditions or mechanisms 421 will vary depending on the gameplay structure as well as the volumetric representation of the components.

Each player may play one species card 24 per turn, but is not required to do so. In order to play a species card 24, the player must link the particular species card to a card already in play. The individual cards must always face, in this particular embodiment, the individual playing the card components 24.

Thus for example, still referring to FIG. 16, a discussion will be provided of the present embodiments unacceptable linking conditions or mechanisms 421 as well as the acceptable linking conditions or mechanisms 423.

First discussing the unacceptable linking condition or mechanisms 421, an improper linking mechanism orientation 101 occurs where a first card 100 is placed in a portrait position and a second card 102 is placed in a landscape position with the intention of the linking components matching. In a two-player game scenario, the landscape linking position will violate the present rules of this game embodiment.

Furthermore, another unacceptable link condition 421 occurs when there is no link mechanism at step 103 to connect the cards. Here the players are attempting to connect adjacent cards which do not have linking components along the adjacent or blank sides. The adjacent card 114 cannot be placed against a second adjacent card 116 because the two card edges do not have link components opposing one another and which also match components according to the acceptable conditions 423.

Furthermore, another unacceptable linking mechanism attempt occurs when the link components on opposing sides do not match. For example, when a first link component is green and an opposing second link component is red, the two link components do not match and the cards cannot be arranged next one another.

Acceptable link conditions or mechanisms 423 include a dual linking mechanism 105 where a first player card 104 is arranged in proper orientation towards the first player, and a second player card 106 is also arranged in the proper orientation, each card component 24 having the same link component 30 color.

Additionally, the link components 30 may have sub-color components such as a first subcomponent 108 as seen in the alternative dual-linking mechanism 107, as well as a second sub-color component 110. Only one of the sub-color components is required to match the adjacent link component 112 color. For example, if the adjacent link component 112 is red, and the current species card component has two subcomponents, a red subcomponent 110 and a purple subcomponent 108, these adjacent species component links 30 can be placed against one another because the first red subcomponent 110 matches the adjacent component 112 which is also red.

Figure 17:
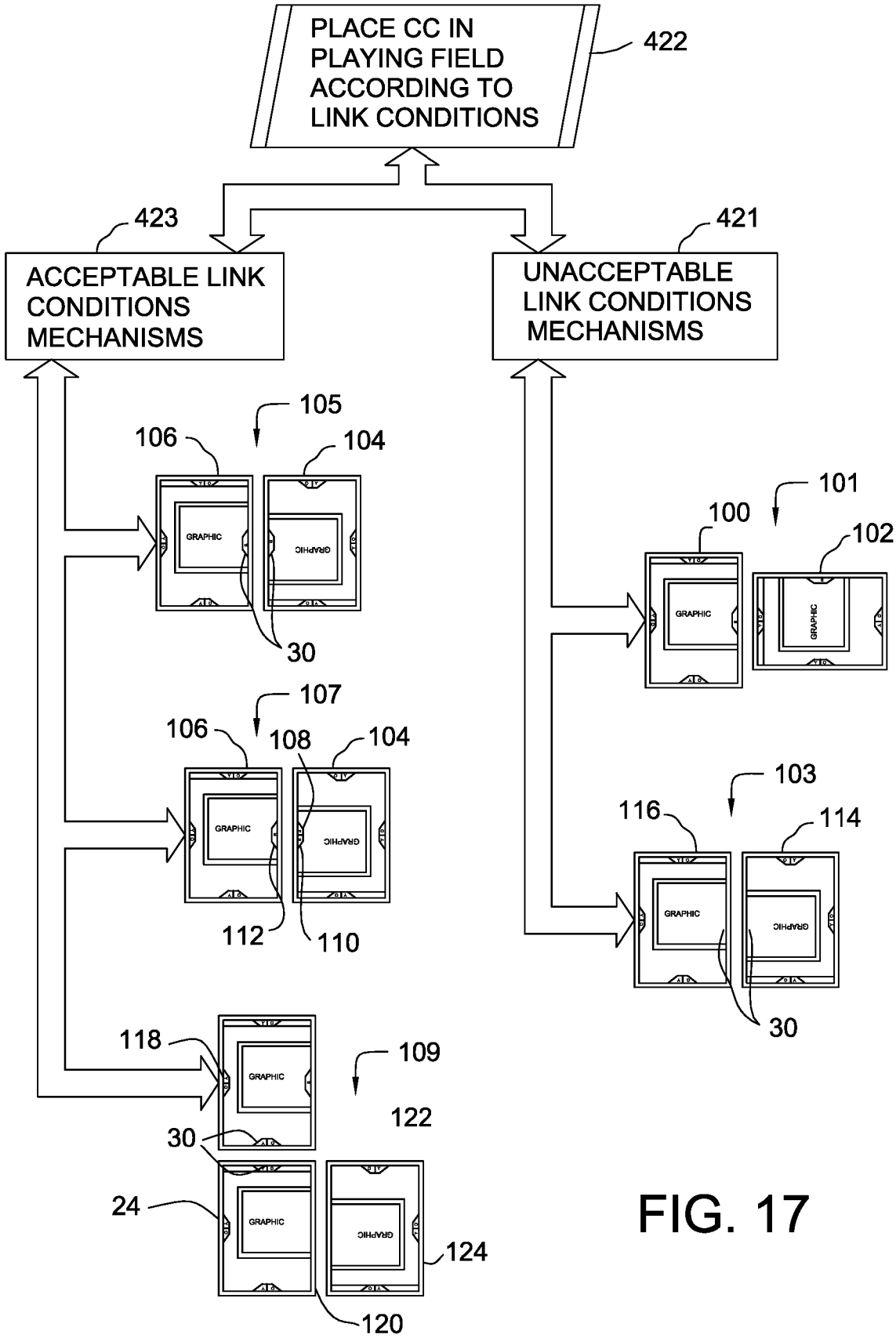
FIG. 17 is a schematic flow diagram of link conditions/mechanisms.

Another acceptable link mechanism is the alternative dual-linking mechanism 109 where a species card component 24 is linked to an opposing opponent's species card 118 with blank sides 120 of the first species card components 24 being adjacent to another blank side 122 of a pre-existing species card 124. Also, multi links between multiple cards can be achieved using the acceptable link conditions 423 above. When a multi link condition occurs, multi link bonuses 152, FIG. 17 are awarded.

While the current embodiment requires there to be a species to species card interaction event to enable the entity power card 62, alternative embodiments provide for use of the entity power card 62 without a direct species to species card interaction event.

Referring now to FIG. 6, the boost cards 62 are used to change the situation in a turf war or in a species 24 to species 24 interaction 140, FIG. 14. The player can utilize powerful or small species to make a large difference or effect within a particular ecosystem being played from a particular hotspot 12 as seen in FIGS. 2 and 3, especially when utilizing the effectiveness of various boost cards 62.

Each boost card 62, as previously discussed, has a number of card elements or components including a card name 64, a card label type 68, and an energy boost level 66, where the energy boost level 66 discloses the amount of energy added to a particular species card 24 during play. Each boost card 62 has particular rules 70 which describe the card's powers, as well as boost card flavor text 71, both which provide extra information about card and have no effect on gameplay.

As previously mentioned, boost cards 62 are only played during turf wars. Each player involved in a particular species-to-species interaction or turf war may play a boost card 62. Boost cards must be linked to the species card 24 involved in the turf war, or the boost card 62 must have been previously played during the particular turf war. In the current embodiment, after the boost card 62 has been used and the turf war is complete, each boost card 62 goes into the player's shed pile and 82 as seen in FIG. 2, and cannot be utilized again. In an alternative embodiment, the boost card 62 is reusable and does not go into the shed pile 82.

Discussing in more detail the various zones of the playing field 10, as seen in FIG. 2, the playing field 10 itself in this particular embodiment is the area in which the species cards 24 are placed to build a ecosystem. The field 10 is centered on the hotspot card 12 just placed at the beginning of the game to start the ecosystem development. Individual players may also use boost cards 62, not shown, during gameplay operation. Boost cards 62 can be placed in the field temporarily. Although a particular play mat 10 is utilized in the current embodiment, it is used only as a guide, and once players are more experienced in the gameplay operation, the field 10 can be wherever players can find room to play the particular card game.

The draw pile 80 is the deck of cards 82 which act as a reservoir for each individual to draw from during gameplay. As previously mentioned, the cards within the draw pile 80 are placed face down so that neither player can see which card is about to be played. Each player can count draw pile cards within the draw pile reservoirs 80 to determine the number of available cards within either the draw pile at any one time. This is strategically allowed so that the individual players can determine if they should draw from the draw pile 80 or conserve their various cards for the end game conservation bonus as seen in FIG. 18.

Player 1 and player 2 each draw five cards into their hand. Players can aggregate more or fewer cards after the initial five cards drawn during or as the play progresses.

The shed pile 86 is the discard pile where the individual players place the cards after they have been utilized. In the present embodiment, the Xeko cards 46 and the boost cards 62 are deposited immediately into the shed pile 86 after their effects are finished. In alternative embodiments, the boost cards may stay resident in the play field 10 until they are removed. In the present embodiment, utilized cards within the shed pile 86 are placed face up, and either player can look at their contents at any time.

The Xeko or ecosystem 84 starts as the initial hotspot card 12 but quickly turns into the combined results of all the linked species cards 24 stemming from the initial hotspot card. At the end of the match, a unique ecosystem 84 has been produced.

Figure 12:
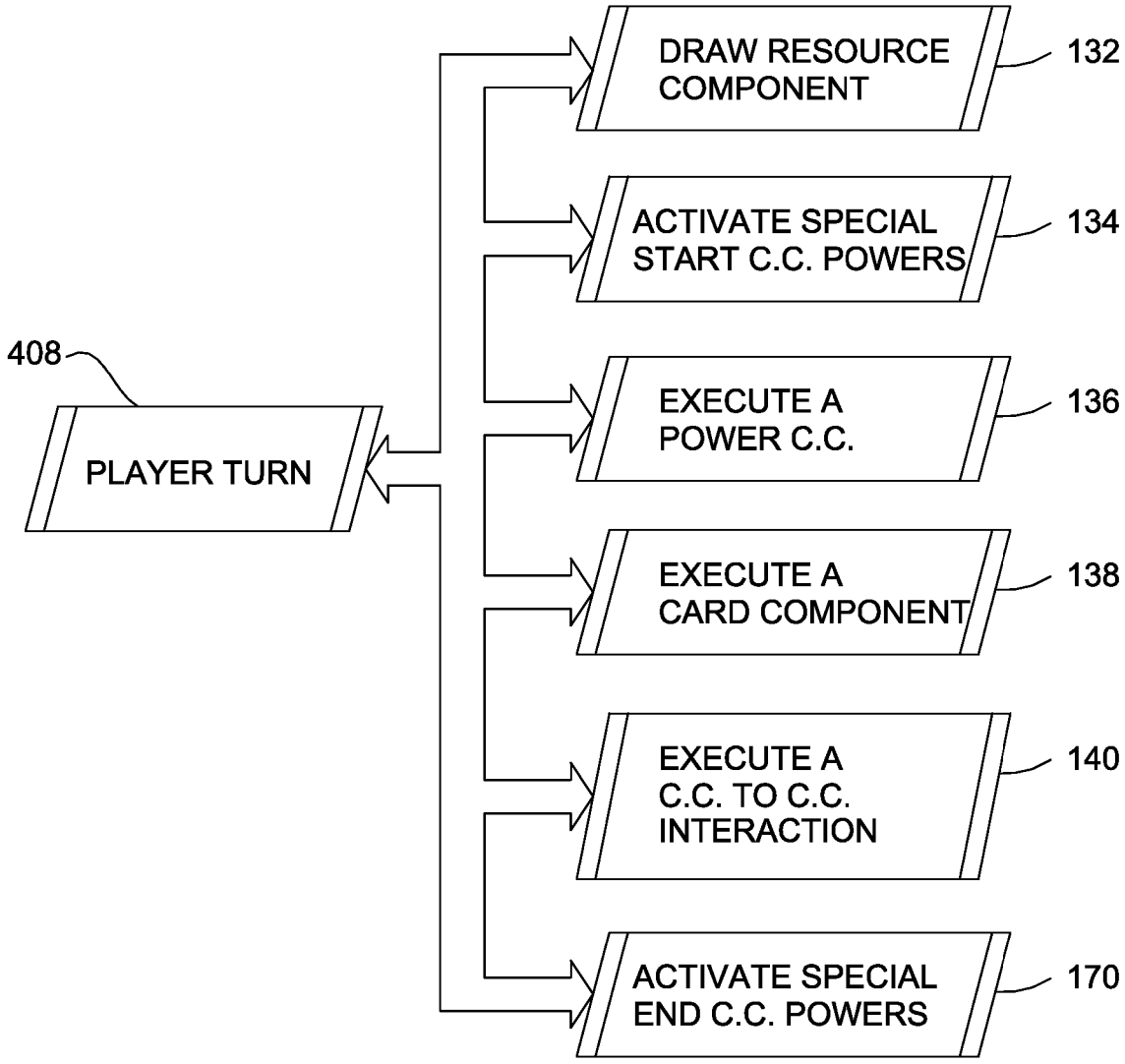
FIG. 12 is a flow diagram of a player turn.

After the players are chosen in step 406, FIG. 11, the players can alternate taking turns at step 408. Discussion of the player turns and the sub play routines within the particular player turn will not be provided. Reference will be made to FIGS. 2, 8 & 12. Briefly, players will start a player turn at step 408, and draw a resource component at step 132; activate a special start card component power at step 134, execute a power card component at step 136, execute a card component at step 138, execute a card component to card component interaction at step 140, or activate a special ending card component power at step 170. A more detailed description of each of these steps will now be provided.

Each player during their turn can at step 132 draw a resource component. This includes drawing a resource component from the draw pile 80 or calling or initializing a resource component 162 from the game component library 336 present within the game database 334 of the game application 332 FIG. 8. If the player cannot draw a resource component from the first set of resource component 80 or drop pile 80, then the game is finished, and the players must resolve the game at step 412 FIG. 11.

After drawing the resource component at step 132, the player can optionally activate a special start card component power at step 134. These special start powers or what is more commonly referred to as sunrise powers, occur on the card components 24, FIG. 4 within the rules component 41. Each card component 24 or species card 24 present within playfield 10, and which has the word sunrise on it may be used by the player to activate it's rules component 41.

An additional optional step during the player's turn at step 408 is to execute a power card component at step 136, FIG. 12. The player can use a power card component 46 or Xeko card 46 FIG. 5 if the card is in the player's hand. A power card component 46 does not have to be played, but the symbol component 56 on the power card component 46 must also appear on the correlating card component 24 located within the field 10. After the Xeko card 46 as been used, it must be placed in the shed pile 86 and cannot be re-accessed. In an alternative embodiment, the Xeko card 46 may be re-accessed. As previously mentioned, the Xeko card symbols 56 as seen on FIG. 5, must be pointed out to the opposing player in order to activating the Xeko card 46 powers. Once the opposing player agrees that all the requirements have been satisfied, the rules or actions within the rules component 60 of the Xeko card 46 can be followed.

Furthermore, an optional step is to execute a card component at step 138. Each individual may play one species card or card component 24 as an option during their turn. The system requires that the species card 24 be placed in position so that the player who owns the card can read it.

Figure 13:
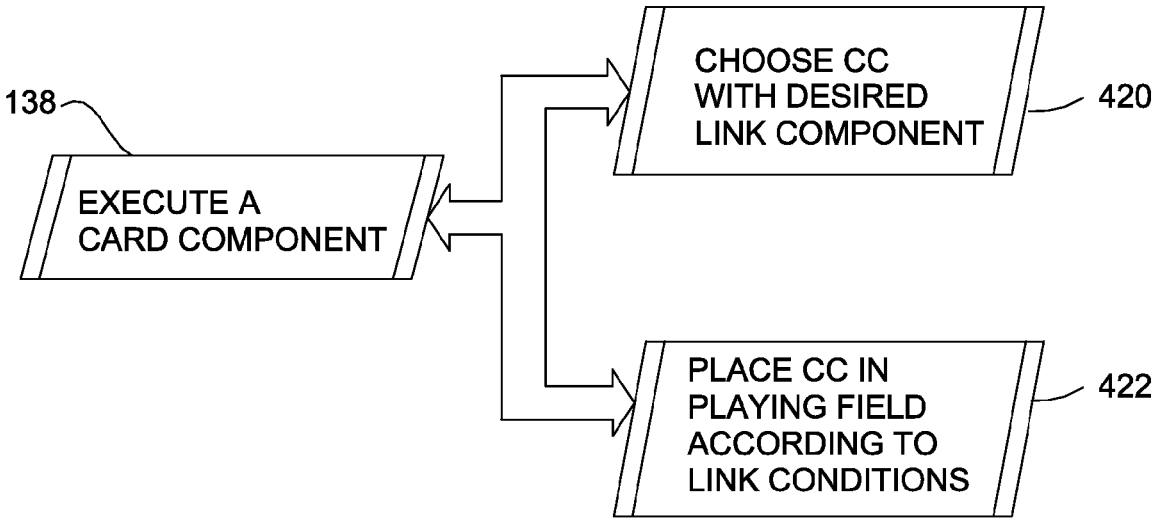
FIG. 13 is a sub-flow diagram of a player turn.

Referring to FIG. 13, the player chooses a Card Component with a designed link component at step 420. The player then places the species card 24 into the play field at step 422 according to the link conditions. The species card 24 must be able to link appropriately to a like-kind link component 30 as previously mentioned above.

The species card 24 can be linked according to the acceptable linking conditions 423, FIG. 16, and link to a set of the player's own cards already within the field 10, or linked to the opponent's cards or the hotspot card 12 as long as the card being linked to is within the field 10 and has the appropriate link component 30 to make the connection. If such a connection is made, then the player has initiated or executed a card component to card component interaction at step 140.

A card component to card component interaction 140 or species-card-to-species-card 24 interaction process 140 or what is more commonly referred to as a turf war 140 can be resolved as seen in FIG. 14. A turf war is a struggle to balance the competing resource needs of neighboring species. The player will begin to understand that a combination of cooperation and competition helps the local ecosystem thrive. During the gameplay, each player serves as an overarching representative for the various species, and players help the species to grow despite the sometimes harsh competition for survival.

When a player links their species card 24 to an opposing component card 24, it triggers a turf war process 140. Once a Turf war processes 140 is begun, the players involved must resolve the process prior to continuing the gameplay.

Generally speaking, the player playing the new coming species card 24 is considered the invading party. The player whose species card 24 is pre-existing within the field 10 is considered to be the defending party. For example, referring to FIG. 14, an invading card component is linked to a defending card component at step 430. Referring to FIG. 15 an invading species card 142 links with a defending species card 144 and a second defending species card 146. The link components 30 are valid matching link components, so once the invading species card 142 is placed onto the field 10, the turf war process 140 begins.

Referring back to FIG. 14, the turf war process 140 further includes the following steps. Activation of special component card powers at step 148 where the players apply relevant card powers which are enabled on species cards 24 located within the field 10 which are owned by the invading player. Furthermore, card powers are applied on any species cards 24 in the field 10 which are owned by the defending player.

The player may optionally execute a power component card or boost card at step 150. Here the invading player may first utilize a boost card 62 as seen in FIG. 6, or pass to the defending player. Similarly, the defending player may play a boost card 62 or pass. Each player may continue to alternatively play boost cards 62 until both players are finished.

After the boost cards and special power cards are played, a multi-link bonus step 152 is initiated. Referring to FIG. 17, as somewhat of an incentive, if the invading species card 142 connects to more than a single pre-existing field card, the invading player receives an energy boost level from the additional cards. For example, if the invading species card 142 links to a first field card 160 and a second field card 162, then the invading species card player receives an additional five units of energy points for the rest of that turn. If the invading species card 142 links to a first card 160, a second card 162, and a third card 164, then the invading species card player receives 10 additional energy units. Similarly, if the invading species card 142 links to a first card 160, a second card 162, and a third card 164 and a fourth card 166, then the invading species card player receives 15 additional eco-energy units for the rest of the turn.

Referring back to FIG. 14, after the multi-link bonus step 152, a winning player step 154 is started. This process compares the energy totals between the two players, awarding the player with the higher energy total points the win between the two parties within the turf war process 140. If the energy totals between the players are the same, the players enter into the cleanup process 158.

The losing player is then assessed a penalty during a penalty phase at 156, where the difference between the winning player's energy points and the losing player's energy points is calculated. The losing player at step 159 sheds or discards a number of cards equal to the difference from the top of their draw pile 80.

Another way of starting a turf war 140 may occur through an invading predator card component linking to a defending card component as seen in step 431, FIG. 15A. Here, a card species 186 having a predator power 187 which is indicated on the card 24.

With a predator power 187 as seen in FIG. 15A, the predator component 186 can trigger a turf war with a defending species card 191, which is positioned diagonally to the opponent's species card 186. The predator species card must be linked to another card 189 present in the playing field and then the player holding the predator card can choose to trigger a turf war with the diagonally positioned species card 191. If the predator species card is linked to a species card owned by another player, the predator card player may choose to begin a turf war with one of the adjacent species cards or with a species card positioned diagonally to the predator card. In the present embodiment, a species predator card effect can only be used once. The player can not use it to start a turf war on subsequent turns.

Returning back to the turn sequence process 408, at the end of the turn sequence process 130, a sunset step 170 occurs at the end of each player's turn. During this closing step, certain powers labeled sunset on the various card within the field 10 can be activated. Only the player whose turn it is can activate sunset card powers. Effects from all boost cards 62, Xeko cards 46, multi-link bonus points from the multi-link application process 152, all stop at the end of the turn during the sunset process 170. The turn sequence 408 continues until gameplay is complete.

Figure 7:
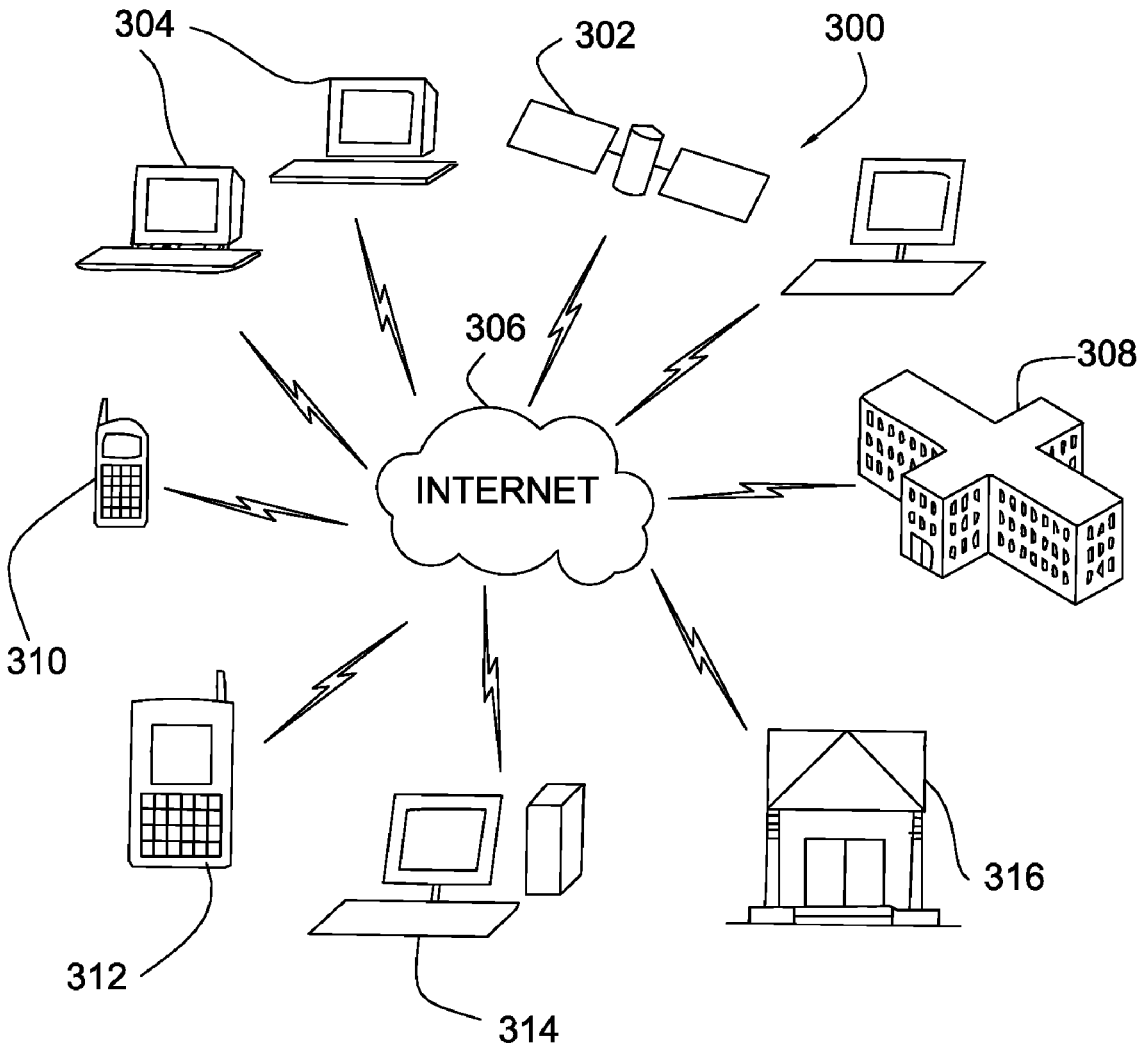
FIG. 7 is a schematic view of an online game system.

Now referring to FIG. 7, a discussion of a game system to support the present concept will now be provided. While the game application may be played in physical form, the game system is portable to any digital medium. In one form the game application may be run through the Internet 306. Other platforms through which the game may be played include: game consoles, mobile platforms, personal computers, miniature computers, micro systems, interactive television (including satellite, cable, and web television). While the present list of platforms can enable the present game application, future platforms which would as readily enable the application are herein conceived.

This embodiment of the game in an online game system 300 in one embodiment utilizes a game server 314 which is interoperable with the Internet 306, various clients can access the game server 314 such as client computers 304, cell phones 310, PDAs 312, tournament locations 308 and financial institutions 316.

Referring to FIG. 8, one embodiment of the game application 332 is provided. The game application in this particular embodiment, draws from the game database 334 which holds the game components 336. The game components 336 are arranged into two groups. First group is the physical components 156 the second is the game play components 186. The game application 302 is in one form hosted completely on the game server 314. The clients 304, 328, and 322 can access and download certain clients specific executable files to be run for example on their Web browsers. These clients and client executable files, communicate with the game server 314 which is hosting the game application 332. In another embodiment, the client 304 can download an entire single executable player game application from the game server 314 to be run locally. In the first embodiment where the clients download portions of game application 332, clients 304 may be part of any large multi-player online gaming environment.

The physical components 156 include the game zone components 158. These components include as previously discussed in FIGS. 2 and 2*a*, the main game zones including the players hands 31, shed pile components 86, the resource or draw pile components 80, the playing field 10, the players 1-4, as well as the active cards or component groups which formed the unique confirming came system 84.

In the software version, the physical components 156 include the game zone components 158 which include the field component 168, the resource component 162, the hand component 160, the shed pile component 164, and a game system component 178.

Also included within the physical components 156 are the central location component 166, the group components 170, card power components 172, the card component 174, a boost components 176, and the game play structure component 180.

The game play component 186 holds various game play methods as outlined above, and which includes the start game component 188, player turn component 190 and a resolve game component 192.

Figure 9:
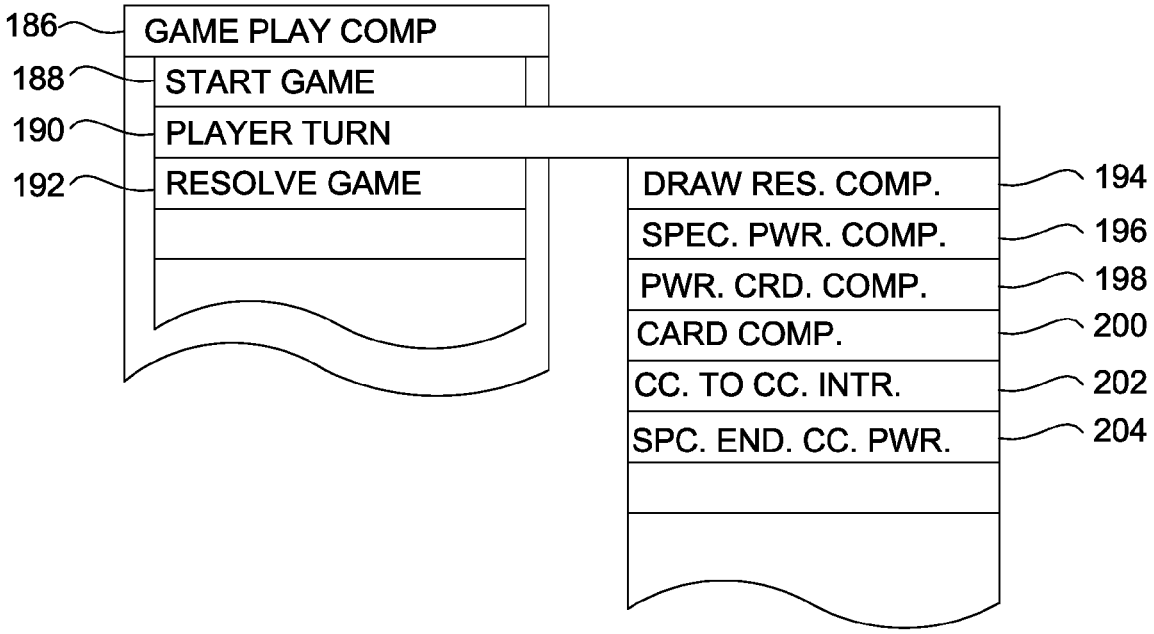
FIG. 9 is a schematic view of game play components.

A discussion of the player turn components as they are executed within the method steps will now be provided. Within the player turn component 190 and referring to FIG. 9, the draw resource component 194 correlates to the draw resource components step 132 as seen in FIG. 12. The special power components 196 correlates to the activating the special start card component power at step 134 FIG. 12. The power card component 198 or what is referred to as the boost card component, correlates to the executing a power card component at step 106 FIG. 12. The card component 200 or as referred in one embodiment as the species card component 24 FIG. 4, correlates to the executing of a card component at step 188 FIG. 12 during the player turn steps 408.

Additionally, the card component to card component interaction 202 correlates to executing a card component to card component interaction at step 140, FIG. 12, which occurs during a player turn at step 408. The special end card component power 204 correlates to the activating of special end card component power at step 170 during a player turn at step 408 in FIG. 12.

Figure 10:
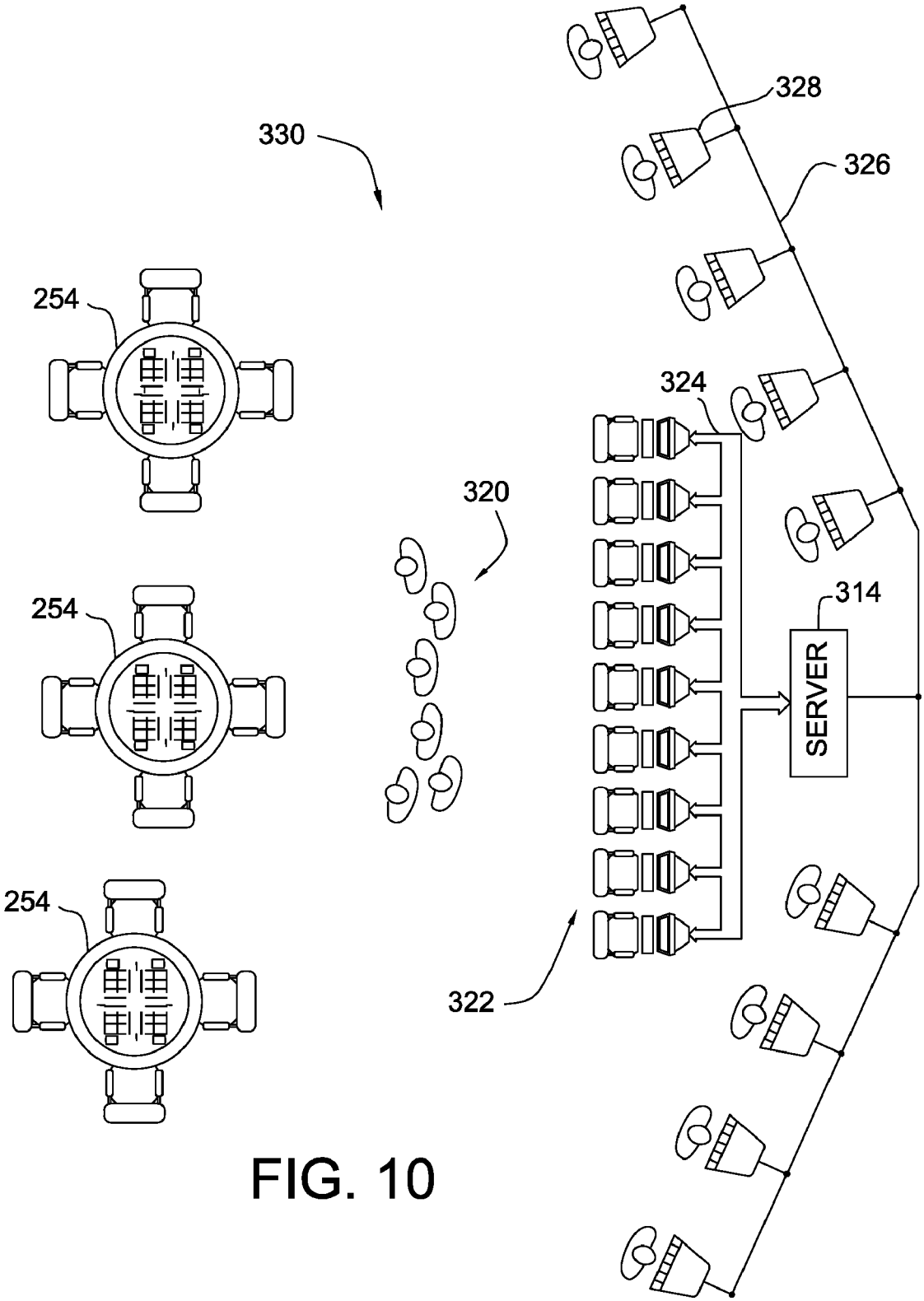
FIG. 10 is a schematic view of a game tournament.

Lastly, the playing of the game can occur in a game tournament environments 330 as seen in FIG. 10. Here spectators 320 watch the players at the game tables 254 playing in this particular embodiment a multi-player version of the game system 250. The server 314 is connected to a plurality of game stations 322 by wireless connection 324. Also the server is connected by a local area network 326 which in this particular embodiment is an Ethernet connection, and various clients 328 are running on the LAN 326 accessing the server 314 to execute various instances of the game application 322 as seen in FIG. 8.

A discussion of the present card powers and implemented in the detailed embodiment will now be provided. While the current list of card powers is provided, future card powers are readily conceived.

Each of the cards themselves have various powers. More particularly, the species card 24 has various power components which indicate various play enabling characteristics. These power components include a ferocity power which adds to the energy level of the species card 24 when the player is invading the field. Another power is a morph power which allows the player to draw additional cards when a species card 24 becomes involved in a turf war process 140. This effect occurs during any player's turn when the card with the morph power becomes the invading or defending species in a turf war process 140. The number of cards drawn from the draw pile 80 equals the number which is indicated after the power component word morph. The morph cards drawn from the draw pile 80 are drawn before any boost cards 62 are played and before the multi-link bonus application 152 is initialized.

A nest power is also provided which adds to a species card point value 28 when the species card is a defending species 144, FIG. 15.

A predator power indicates that the player using the card can trigger a turf war process 140 using any species card 24 which is positioned diagonally to the species card currently being played. This effect only occurs when the player uses the species card 24. The existing species card must be linked to another card and the field 10 as normally would be applied, and then the player can choose to trigger a turf war process 140 with the species card that is positioned diagonally. If the species card 24 with the predator component 186 is linked to a species card 24 owned by another player, the invading player may choose to begin a turf war process 140 with one of the adjacent species cards or a species card positioned diagonally. The species predator component 186 effect may only be used once. The player cannot use it to start a turf war process 140 on subsequent turns.

As previously mentioned, a sunrise power has a special classification for powers that happen at the beginning of the player's turn. All powers at sunrise start at the beginning of each player's turn. Similarly, a sunset power is a special classification for powers that happened at the end of the player's turn.

A migrate power allows the player to move a species card 24 to a better location on the field 10. The player may wish to do this in order to set up a multi-link bonus process 152, for a later time. Thus the power can only be activated during the sunrise step of a player's turn. The power does not have to be activated and is a conditional power. To activate this migrating power the player must shed or discard from the top of the draw pile 80 to the shed pile 86, the number of cards written in the rules text of the species card 24 having the migration power. After the player has shed the appropriate number of cards, the player can move the species card 24 to another open spot within the field 10.

The player can choose a new location of the current species card 24 but must meet all pre-existing rules such as linking with appropriate card component links 30. The player may only move a species card 24 in play using a migration power once per turn.

In addition to the above species card powers, a warning call power is provided. This power allows a player to move the different species card 24 of the players within the field 10 to another location within the field. This may be desirable in order to set up a multi-link bonus process 152 later in the gameplay when the player uses the species card 24. This warning call power may only be activated during the sunrise process 134 of the player's turn. This is a conditional process which does not have to be activated. The player will choose a species card 24 which is linked to the existing card having the warning call power, and move the chosen species card 24 to another open or legal spot within the field 10. The species card 24 can only by moved using a warning call power once per turn.

Within the gameplay, and the various card decks 82 (FIG. 2), are various instantaneous cards which are either species cards 24, Xeko cards 46, or entity power cards 62 such as boost cards 62 which have certain unique properties. These include a comet orchid card which when played allows the player to immediately use a hawk moth species card from his or her hand if the player currently has one. The hawk moth species card must be linked to the common orchid card when it is played. The hawk moth triggers a turf war process 140; the turf war is resolved as usual.

A card having a swarm symbol can be played which allows the player to total the number of species cards in play and owned by any player and which has a particular swarm card symbol located on the card. The number of cards is multiplied by two to determine the total number of energy boost points provided by the card with the swarm card symbol.

A toxic card requires the player to look at the energy value printed on a particular species card 24 being boosted by the toxic card. That value is the total energy boost provided by the toxic card.

A sticky web trap card changes the valuable boost cards 62 played by the other players to zero for a particular turf war instance 140. This affects boost cards 62 that have already been played by the opponents within the current turf war 140 as well as cards that are played later during the turf war 140.

A golden bamboo lemur card allows the player to skip the played boost card phase of the turf war 140. No boost cards may be played by either player if the golden bamboo lemur card is used. This effect happens regardless of whether or not the players are the invading party or the defending party.

A peace offering card allows players to use a species card 24 during the play of the Xeko card 46. Any species card 24 played during this process does not trigger a turf war 140.

A new reserve card allows a player to use two species cards 24 during the play of the species card step within the sequence process 130. Turf wars 140, as well as other effects, card powers, and rules, are executed as normal for both species cards utilized through the use of the new reserve card. The player using the new reserve card is allowed to ignore the effect of having two cards if the player chooses to do so.

A heavy storm card ends a turf war process 140 immediately when it is played. No other cards may be used by either player after a heavy storm card is used. Energy totals for the instantaneous turf war process 140 are calculated or considered equal. The players must then proceed to the cleanup process 158 of the turf war 140.

And indri card allows the player to use a species card 24 at the end of a turf war 140 when an indri card has been played. The use of the species card 24 after the indri card has won the turf war 140 and does not trigger a subsequent turf war 140.

A brown mouse lemur allows a player to use a species card 24 at the end of any turf war 140 that is won using a brown mouse lemur card. The species card played in this manner does not trigger a turf war process 140.

We claim:

1. A resource component for a game, said resource component comprising:

a. a gameplay structure and a linking mechanism;

b. said linking mechanism arranged about said gameplay structure;

c. said linking mechanism dictating a gameplay condition by indicating the availability of said gameplay structure for inclusion into a first component group;

d. said resource component is part of a first set of resource card components comprising at least said resource component;

e. said first card component group interacting with a second card component group about a central card component arranged within a playing field;

f. a second resource component comprising a second gameplay structure and a second linking mechanism arranged about said second gameplay structure; said second resource component part of a second set of resource card components comprising at least said second resource component;

g. said second linking mechanism dictating said gameplay condition by indicating the availability of said second gameplay structure for inclusion into said second component group;

h. said first card component group arranged on said playing field in a first card player facing arrangement; said second card component group arranged on said playing field in a second card player facing arrangement not the same as said first card player facing arrangement;

i. a plurality of points located on each of said first component group and said second component group respectively; each of said first and second component groups building a first and second value within said playing field by utilizing said first and second linking mechanisms respectively;

j. wherein at the end of the game, the first and second component group points are tallied utilizing said first and second linking mechanisms to determine a winning value.

2. The resource component according to claim 1 wherein said gameplay structure further comprises a two-dimensional card component.

3. The resource component according to claim 1 wherein said resource component further comprises: said gameplay structure comprising a two-dimensional card component comprising a first perimeter edge, said linking mechanism further comprising a first linking component, said first linking component arranged along said first perimeter edge.

4. The resource component according to claim 3 wherein said gameplay structure further comprises: a second perimeter edge, said linking mechanism further comprising a second linking component, said second linking component arranged along said second perimeter edge.

5. The resource component according to claim 4 wherein said gameplay structure further comprises: a third perimeter edge, said linking mechanism further comprising a third linking component, said third linking component arranged along said third perimeter edge.

6. The resource component according to claim 5 wherein said gameplay structure further comprises: a fourth perimeter edge, said linking mechanism further comprising a fourth linking component, said fourth linking component arranged along said fourth perimeter edge.

7. The resource component according to claim 1 wherein said resource component further comprises: said gameplay structure comprising a two-dimensional card component comprising a plurality of perimeter edges, said linking mechanism further comprising a plurality of linking components, each of said plurality of linking components arranged about one of said plurality perimeter edges.

8. The resource component according to claim 1 wherein said gameplay structure further comprises a three-dimensional game component.

9. The resource component according to claim 1 wherein said linking mechanism further comprises: a color component to match with an opposing color component.

10. The resource component according to claim 1 wherein said linking mechanism further comprises: a value component to match with an opposing value component.

11. The resource component according to claim 1 wherein said linking mechanism further comprises: a symbol component to match with an opposing symbol component.

12. The resource component according to claim 1 wherein said linking mechanism further comprises: a alphanumeric component to match with an opposing alphanumeric component.

13. The resource component according to claim 1 wherein said resource component further comprises: an entity component comprising a value component, a victory component; said entity component interacting with a second entity component in said game.

14. The resource component according to claim 13 wherein said entity component further comprises a graphic component.

15. The resource component according to claim 1 wherein said resource component further comprises a rarity rating component, said rarity rating component correlated to a real-world inventory.

16. The resource component according to claim 1 wherein said resource component further comprises: a power component; said power component comprising a power value component to combine with a card component to increase said card component value.

17. The resource component according to claim 1 wherein said resource component further comprises:

k. a card component comprising a value component, a victory component, a rarity component;

l. said linking mechanism further comprising a first linking component to match an opposing linking component.

18. The resource component according to claim 1 wherein said first set of resource components further comprises: a first group of common resource components with linking mechanism correlated to a common real world inventory.

19. The resource component according to claim 1 wherein said first set of resource components further comprises: a first group of rare resource components with linking mechanism correlated to a rare real world inventory.

20. The resource component according to claim 1 wherein said first set of resource components further comprises: a first group of super rare resource components with linking mechanism correlated to a super rare real world inventory.

21. The resource component according to claim 1 wherein said first set of resource components further comprises: a first group of uncommon resource components with linking mechanism correlated to an uncommon real world inventory.

22. The resource component according to claim 1 wherein said first set of resource components further comprises a draw pile component.

23. The resource component according to claim 1 wherein said first resource component further comprises a gameplay structure without a linking mechanism.

24. The resource component according to claim 1 wherein said first set of resource components further comprises a first group of additional resource components with linking mechanisms, each of said resource components within said first group of additional resource components with linking mechanisms comprising additional gameplay structures.

25. The resource component according to claim 1 wherein said first set of resource components further comprises: a rarity rating correlated to a real-world inventory of said first set of resource components.

26. The resource component according to claim 1 wherein said game further comprises:

o. said winning value chosen to be either said first value or said second value, whichever is greater.

27. The resource component according to claim 26 wherein said value further comprises: at the end of said game, a player with resource components left receives a bonus.

28. A game tournament apparatus comprising:

a. a first set of game tables comprising a first game table;

b. said first game table comprising a first set of players, a game system;

c. said game system comprising:

d. a first component group interacting with a second component group within a playing field, said first component group arranged on said playing field in a first card player facing arrangement; said second component group arranged on said playing field in a second card player facing arrangement not the same as said first card player facing arrangement;

e. said first component group comprising a first set of resource components comprising a first resource component comprising a first linking mechanism and a first gameplay structure;

f. said second component group comprising a second set of resource components comprising a second resource component comprising a second linking mechanism and a second gameplay structure;

g. a plurality of points located on each of said first component group and said second component group respectively;

h. said first component group building a first value within said playing field by utilizing said first linking mechanism;

i. said second component group building a second value within said playing field by utilizing said second linking mechanism;

j. wherein at the end of the game, the first and second component group points are tallied utilizing said first and second linking mechanisms;

k. a winner of said game, said winner comprising a greater value between said first value and said second value.

* * * * *